US008566007B2

(12) United States Patent
Shoda et al.

(10) Patent No.: US 8,566,007 B2
(45) Date of Patent: Oct. 22, 2013

(54) AUTOMATIC STOP/RESTART DEVICE FOR INTERNAL COMBUSTION ENGINE

(75) Inventors: Tomohisa Shoda, Chiyoda-ku (JP); Osamu Ishikawa, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 62 days.

(21) Appl. No.: 13/276,494

(22) Filed: Oct. 19, 2011

(65) Prior Publication Data

US 2012/0290194 A1 Nov. 15, 2012

(30) Foreign Application Priority Data

May 11, 2011 (JP) ..... 2011-105788

(51) Int. Cl.
*F02D 28/00* (2006.01)
*F02D 41/30* (2006.01)
*F02N 11/08* (2006.01)

(52) U.S. Cl.
USPC ..... 701/104; 123/179.3

(58) Field of Classification Search
USPC ..... 123/179.3, 179.4; 701/104, 113; 290/38 R
See application file for complete search history.

(56) References Cited

U.S. PATENT DOCUMENTS 7,218,010 B2 * 5/2007 Albertson et al. ..... 290/38 R
7,275,509 B2 * 10/2007 Kassner ..... 123/179.25
8,069,832 B2 * 12/2011 Okumoto et al. ..... 123/179.4
2009/0224557 A1 * 9/2009 Reynolds et al. ..... 290/38 R
2010/0050970 A1 * 3/2010 Okumoto et al. ..... 123/179.4
2010/0059007 A1 * 3/2010 Senda et al. ..... 123/179.4

FOREIGN PATENT DOCUMENTS

DE 102010017025 A1 12/2010
JP 2005-330813 A 12/2005
JP 2010084754 A 4/2010
JP 2010236533 A 10/2010
JP 2011074912 A 4/2011

OTHER PUBLICATIONS

German Office Action dated Mar. 25, 2013 issued in corresponding German Patent Application No. 102011085897.0, English-language translation.
Japanese Office Action dated Dec. 25, 2012 issued in corresponding Japanese Patent Application No. 2011-105788, English-language translation.

* cited by examiner

*Primary Examiner* — Stephen K Cronin
*Assistant Examiner* — Arnold Castro
(74) *Attorney, Agent, or Firm* — Sughrue Mion, PLLC

(57) ABSTRACT

The automatic/stop restart device includes a restart control module for performing restart control for the internal combustion engine by pushing out a pinion gear (17) by a pinion-gear push-out device (18) to bring the pinion gear into meshing engagement with a ring gear (16) when the restart requirement is satisfied before the rotation of the internal combustion engine is stopped after an automatic stop requirement is satisfied. The pinion gear is pushed out when the restart requirement is satisfied when a rotation speed of the internal combustion engine is equal to or lower than a predetermined rotation speed. At the same time, a starter motor (19) is driven by a starter-motor waiting-time adjustment module for adjusting a driving waiting time for the starter motor (19) according to the rotation speed of the internal combustion engine obtained when the restart requirement is satisfied. In this manner, the restart is quickly performed.

5 Claims, 16 Drawing Sheets

AUTOMATIC STOP/RESTART DEVICE FOR INTERNAL COMBUSTION ENGINE

BACKGROUND OF THE INVENTION

1. Field of the Invention

The present invention relates to an automatic stop/restart device for an internal combustion engine, which automatically stops the internal combustion engine when a predetermined automatic stop requirement is satisfied while the internal combustion engine is in operation and restarts the internal combustion engine when a predetermined restart requirement is satisfied while the internal combustion engine is in an automatically stopped state.

2. Description of the Related Art

In recent years, some internal combustion engines to be mounted in a vehicle use an automatic stop/restart device (so-called idling-stop device) for the internal combustion engine mainly for the purpose of reduction in fuel consumption. The automatic start/restart device for the internal combustion engine automatically stops the internal combustion engine when a predetermined automatic stop requirement is satisfied according to a deceleration operation and a vehicle stop operation, which are performed by a driver who is driving the vehicle. The automatic start/restart device for the internal combustion engine automatically restarts the internal combustion engine when a predetermined restart requirement is satisfied according to an operation for starting the vehicle, which is performed by the driver.

The restart performed by the automatic stop/restart device for the internal combustion engine has the following problem. When the driver performs the operation for starting the vehicle (restart request operation) while the internal combustion engine is rotating by inertia after being automatically stopped, a pinion gear, which is provided to a starter for performing an operation for starting the internal combustion engine, and a ring gear, which is connected to a crankshaft of the internal combustion engine, cannot be brought into meshing engagement with each other because of a difference in rotation speed between the ring gear and the pinion gear. Therefore, it is necessary to wait to restart the internal combustion engine until the internal combustion engine is stopped, and hence there is a problem in that the internal combustion engine is not restarted in response to the restart request operation by the driver.

In order to solve the problem described above, the following technology is disclosed. According to the technology, while the rotation speed of the ring gear and the rotation speed of the pinion gear are monitored in response to the restart request operation, the pinion gear is moved to be brought into meshing engagement with the ring gear after the rotation speed of the pinion gear comes into synchronization with the rotation speed of the ring gear. In this manner, the restart is performed (see Japanese Patent Application Laid-open No. 2005-330813).

However, the technology described in Japanese Patent Application Laid-Open No. 2005-330813 has the following problems. Specifically, a sensor for detecting the rotation speed of the ring gear and the rotation speed of the pinion gear is required. Further, control means for the pinion gear (starter motor) becomes complicated because the rotation speed of the pinion gear is adjusted so that the rotation speed of the pinion gear and the rotation speed of the ring gear come into synchronization with each other while the rotation speeds of the ring gear and the pinion gear are being monitored. In addition, the use of a shunt coil for the starter motor for adjusting the rotation speed of the pinion gear complicates a device structure of the starter to disadvantageously increase the weight and cost of the starter.

SUMMARY OF THE INVENTION

The present invention has been made to solve the problems described above, and therefore has an object to provide an automatic start/restart device for an internal combustion engine, which does not include a sensor for detecting a rotation speed of a pinion gear and a rotation speed of a ring gear, can bring the pinion gear and the ring gear into meshing engagement without the need of monitoring the rotation speeds of the pinion gear and the ring gear, can drive a starter motor without including a shunt coil for adjusting the rotation speed of the pinion gear to simplify control means for the starter motor and a device structure of a starter, and can prevent an increase in weight of the starter and in cost.

According to the present invention, there is provided an automatic stop/restart device for an internal combustion engine, for automatically stopping the internal combustion engine when a predetermined automatic stop requirement is satisfied during an operation of the internal combustion engine and for restarting the internal combustion engine when a predetermined restart requirement is satisfied while the internal combustion engine is in an automatically stopped state, including: rotation-speed computation means for computing a rotation speed of the internal combustion engine; a starter including a pinion gear to be brought into meshing engagement with a ring gear connected to a crankshaft of the internal combustion engine to rotationally drive the ring gear, a pinion-gear push-out device for bringing the pinion gear into the meshing engagement with the ring gear, a starter motor for rotationally driving the pinion gear, and a starter-motor driving device for driving the starter motor; and restart control means for allowing the pinion-gear push-out device to push out the pinion gear, after elapse of a driving waiting time for the starter motor, which is computed based on a plurality of characteristics obtained in advance, allowing the starter-motor driving device to drive the starter motor, and restarting fuel supply from a fuel injection valve to a combustion chamber of the internal combustion engine, when the rotation speed of the internal combustion engine at time of satisfaction of the predetermined restart requirement, the rotation speed being computed by the rotation-speed computation means, is lower than a lower limit rotation speed at which the starter can be operated in order of the driving of the starter motor and the pushing of the pinion gear, in a case where the predetermined restart requirement is satisfied while the internal combustion engine is rotating by inertia after being automatically stopped.

According to the automatic stop/restart device for the internal combustion engine according to the present invention, the automatic stop requirement is satisfied while the internal combustion engine is operating. Then, when the restart requirement is satisfied, the pinion gear is pushed out while the internal combustion engine is rotating by inertia. In addition, the driving waiting time for the starter motor is adjusted according to the rotation speed of the internal combustion engine obtained at the time of satisfaction of the restart requirement. Therefore, the pinion gear and the ring gear can be reliably brought into meshing engagement with each other without increasing the rotation speed of the pinion gear to the rotation speed of the ring gear or higher. Therefore, a restart operation can be quickly performed. Moreover, the restart operation can be performed without monitoring the rotation speed of the pinion gear and without adjusting the rotation speed of the pinion gear in synchronization with the rotation speed of the ring gear. Therefore, control means for the pinion gear (starter motor) and a device structure of the starter motor are not complicated. Further, the weight of the starter and cost are not increased because the device structure of the starter motor is not complicated.

DETAILED DESCRIPTION OF THE PREFERRED EMBODIMENTS

Hereinafter, an automatic stop/restart device for an internal combustion engine according to preferred embodiments of the present invention is described referring to the accompanying drawings.

Embodiment 1

Figure 1:
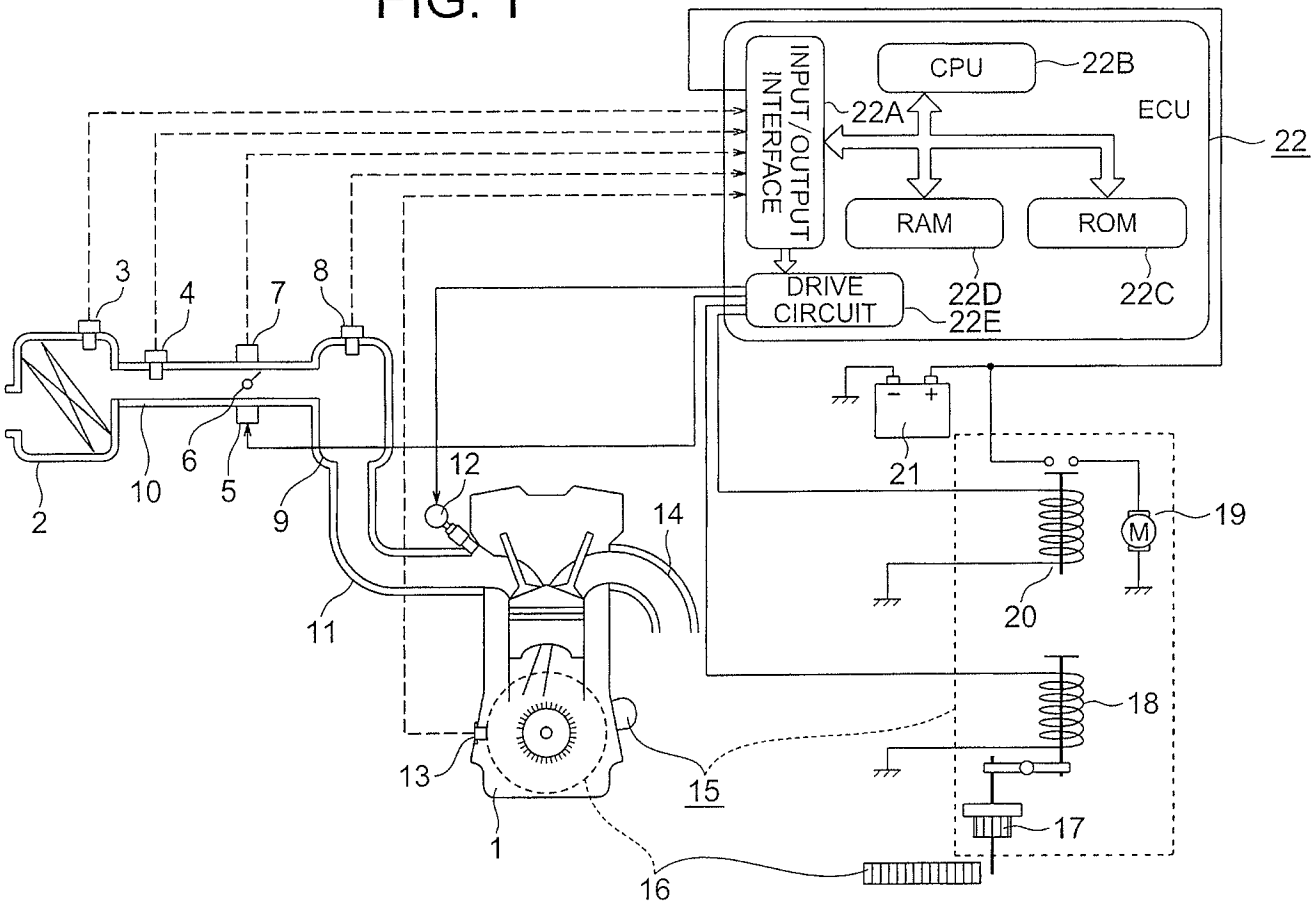
FIG. 1 is a view illustrating a configuration of an automatic stop/restart device for an internal combustion engine, according to Embodiment 1 of the present invention.

An automatic stop/restart device for an internal combustion engine according to Embodiment 1 of the present invention is described referring to FIGS. 1 to 12. FIG. 1 is a diagram illustrating a configuration of the automatic stop/restart device for the internal combustion engine according to Embodiment 1 of the present invention. Hereinafter, the same reference symbols denote the same or equivalent parts in the drawings.

In FIG. 1, an air filter 2 is provided upstream of an intake pipe 10 for sucking air into an internal combustion engine (hereinafter, referred to simply as "engine") 1. Downstream of the air filter 2, an intake-air temperature sensor 3 for detecting a temperature of the intake air and an airflow sensor 4 are provided. Downstream of the airflow sensor 4, a throttle valve 6 and a throttle-valve opening-degree sensor 7 are provided. The throttle valve 6 adjusts a flow rate of the intake air by a motor 5. The throttle-valve opening-degree sensor 7 detects an opening degree of the throttle valve 6.

Downstream of the throttle valve 6, a surge tank 9 and an intake pressure sensor 8 for detecting an intake pressure of the surge tank 9 are provided. Downstream of the surge tank 9, an intake manifold 11 for supplying the intake air to a combustion chamber of each cylinder of the engine 1 is provided. A fuel injection valve 12 is provided in the vicinity of an intake port of each cylinder. A mixture of the air supplied to the combustion chamber and a fuel supplied from the fuel injection valve 12 is ignited by a spark plug (not shown) provided to the combustion chamber of each cylinder to cause a combustion. The combustion gas passes through an exhaust pipe 14 and a catalyst (not shown) to be exhausted to atmosphere.

The engine 1 is also provided with a water-temperature sensor (not shown) and a crank-angle sensor 13. The water-temperature sensor detects a temperature of cooling water for the engine 1. The crank-angle sensor 13 detects a signal each time a crankshaft (not shown) of the engine 1 rotates by a predetermined angle. Based on the detection signal of the crank-angle sensor 13, the crank angle and a rotation speed Ne of the engine 1 are computed by crank-angle computation means and rotation-speed computation means of an engine control unit (hereinafter, abbreviated as "ECU") 22 described below.

The engine 1 is further provide with a starter 15. The starter 15 rotationally drives a ring gear 16 connected to the crankshaft of the engine 1 for start or restart by turning a key (not shown) ON. A clutch (not shown) is connected to the engine 1. The clutch performs an engagement operation and an opening operation in response to a drive signal from the ECU 22 described below and is further connected to a transmission (not shown). An output, which is generated when the engine 1 operates, is transmitted to a wheel (not shown) through an intermediation of the transmission while the clutch is held in an engaged state. The starter 15 includes a pinion gear 17, a pinion-gear push-out device 18, and a series-coil type starter-motor driving device 20. The pinion gear 17 comes into meshing engagement with the ring gear 16 to rotationally drive the ring gear 16. The pinion-gear push-out device 18 brings the pinion gear 17 into meshing engagement with the ring gear 16. The starter-motor driving device 20 drives a starter motor 19 to rotationally drive the pinion gear 17. The starter-motor driving device 20 and the pinion-gear push-out device 18 are individually driven by drive signals from the ECU 22. An operation of the starter 15 is described below. A battery 21 supplies electric power to the starter 15, the ECU 22, and the various sensors described above.

The ECU 22 includes an input/output interface 22A, a CPU (microprocessor) 22B, a read-only memory (ROM) 22C, a random-access memory (RAM) 22D, and a drive circuit 22E. The input/output interface 22A receives output signals from the aforementioned various sensors and detection signals of the amount of depression of an accelerator pedal (not shown) and the amount of depression of a brake pedal (not shown). The CPU 22B performs a computation for whether or not control for automatic stop/restart of the engine 1 can be performed. The ROM 22C stores a control program used for various computations of the CPU 22B and various constants. The RAM 22D temporarily stores the results of computations performed in the CPU 22B. The drive circuit 22E transmits a drive signal to the fuel injection valve 12 or the like according to the results of computation from the CPU 22B.

The ECU 22 executes the computation of the rotation speed of the engine 1 based on the detection signal of the crank-angle sensor 13 described above. In addition, the CPU 22 uses the control program and the control constants stored in the ROM 22C to determine an operating state of the engine 1 based on the detection signals of the various sensors such as the intake-air temperature sensor 3 and also outputs a drive signal and the amount of control according to the intention of a driver to the fuel injection valve 12 and the motor 5 to control the engine 1. Further, the ECU 22 determines whether or not an automatic stop requirement or a restart requirement of the engine 1 according to the present invention is satisfied and controls the amount of control of the throttle valve 6 and the clutch after the automatic stop requirement is satisfied to perform control on the starter 15 when the restart requirement is satisfied.

An operation of the starter 15 is now described. First, at the key-ON start or when the restart requirement is satisfied after the engine 1 is automatically stopped to stop the rotation of the engine 1, a computation for start or a computation for restart is performed by the ECU 22 based on the input signals of the various sensors. The drive signal is transmitted from the ECU 22 to the pinion-gear push-out device 18 to start energization. As a result, the pinion gear 17 is pushed out to come into meshing engagement with the ring gear 16. Thereafter, the drive signal is transmitted from the ECU 22 to the starter-motor driving device 20 to supply electric power from the battery 21 to the starter motor 19 so as to drive the starter motor 19. Then, the rotational driving of the engine 1 is started through an intermediation of the pinion gear 17 and the ring gear 16, thereby starting cranking.

After the restart requirement is satisfied while the engine 1 is rotating by inertia after the engine 1 is automatically stopped, the drive signal is transmitted from the ECU 22 to the starter-motor driving device 20 or the pinion-gear push-out device 18 according to a rotation speed Ne of the engine 1, which is obtained by the ECU 22, based on the detection signal of the crank-angle sensor 13 as described below. In this manner, the starter 15 is driven.

Next, an operation of the automatic stop/restart device for the internal combustion engine according to Embodiment 1 is described referring to the drawings.

Figure 2:
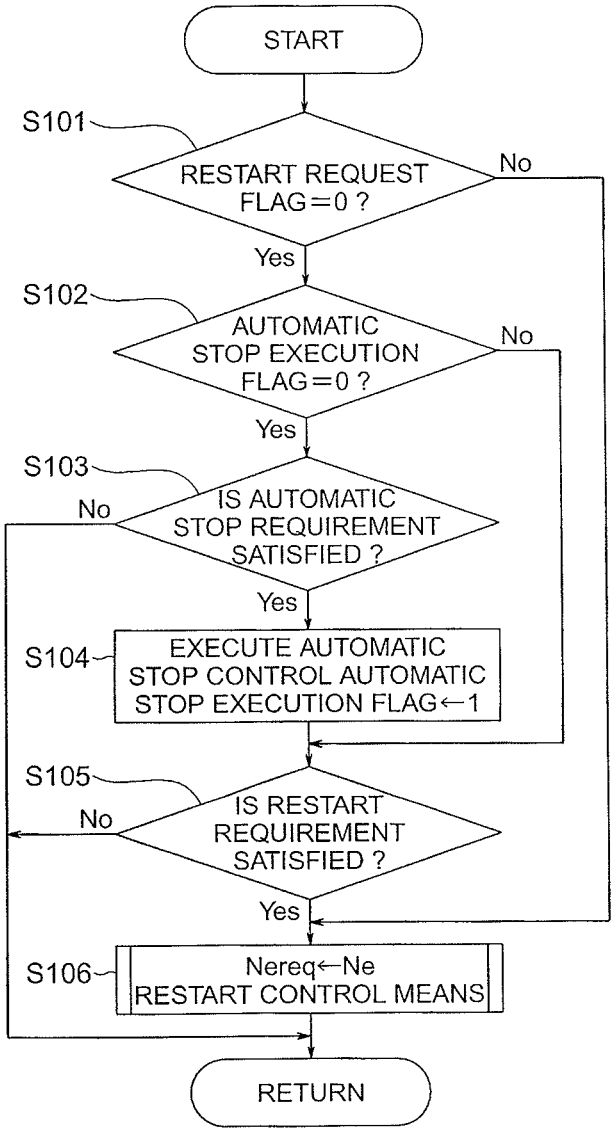
FIG. 2 is a flowchart illustrating an automatic stop/restart operation of the automatic start/restart device for the internal combustion engine, according to Embodiment 1 of the present invention.

First, an operation of automatic stop and restart of the engine is described referring to a flowchart of FIG. 2. FIG. 2 is a flowchart illustrating the operation of automatic stop and restart of the automatic stop/restart device for the internal combustion engine according to Embodiment 1 of the present invention. The operation is executed in the ECU 22.

First, in Step (hereinafter, referred to simply as "S") 101, the ECU 22 determines a value of a restart request flag. The restart request flag is set only while restart control means (restart control program) is being executed as a result of the satisfaction of the restart requirement after automatic stop control described below is performed. When the engine 1 is stopped due to other factors than the automatic stop or is normally operated, the restart request flag is not set.

When the engine 1 is normally operated or placed in a stopped state due to other factors than the automatic stop, the result of determination in S101 is Yes. Therefore, the operation proceeds to Step S102. On the other hand, when the result of determination in S101 is No, specifically, when the restart request flag is 1, the restart control means is currently executed after the automatic stop. Therefore, the operation proceeds to S106 described below.

In S102, a value of an automatic stop execution flag is determined. The automatic stop execution flag is set only when the automatic stop control is performed as a result of the satisfaction of the automatic stop requirement of the engine 1 described below. The automatic stop execution flag is not set when the engine 1 is normally operated or is stopped due to other factors than the automatic stop. When the result of determination in S102 is Yes, the operation proceeds to S103 because the engine is normally operated or is stopped due to other factors than the automatic stop. On the other hand, when the result of determination in S102 is No, the engine 1 is in an automatically stopped state. Therefore, the operation proceeds to S105 described below.

In S103, whether or not the automatic stop requirement is satisfied is now determined. The satisfaction of the automatic stop requirement is determined in view of various kinds of information for determining the deceleration operation or the operation for stopping the vehicle, which is performed by the driver. The information includes, for example, whether the temperature detected by the water-temperature sensor is equal to or higher than a predetermined temperature (for example, 65 degrees), whether or not a vehicle velocity equal to or higher than a predetermined velocity (for example, 15 km/h) has been detected at least once, a current vehicle velocity is equal to or lower than a predetermined speed (for example, 0 km/h), whether or not the brake pedal is currently depressed, and whether or not the amount of depression of the accelerator pedal is equal to or smaller than a predetermined value (for example, the amount of depression is zero).

When the automatic stop requirement is satisfied, the result of determination in S103 is Yes. Therefore, the operation proceeds to S104 where the automatic stop control is performed and the automatic stop execution flag is set to 1. Then, the operation proceeds to S105. When the automatic stop control is performed in S104, the transmission of the drive signal to the fuel injection valve 12 is stopped to stop the fuel injection to the engine 1 and limit the amount of control of the throttle valve 6. Further, the automatic stop control by opening the clutch to release a connected state between the engine and the transmission is performed. The amount of control of the throttle valve 6 in the automatic stop control is limited to release the engaged state between the engine 1 and the clutch to enable a reduction in fluctuation in the rotation speed Ne of the engine 1 after the automatic stop control is performed. Therefore, the rotation speed Ne of the engine 1 can be reduced at a uniform rate. On the other hand, when the result of determination in S103 is No, at least one condition of the automatic stop requirement is not satisfied because, for example, the vehicle velocity equal to or higher than the predetermined velocity is not detected even once. Therefore, the operation returns.

In S105, whether or not the restart requirement is satisfied is determined. The satisfaction of the restart requirement is determined in view of various kinds of information for determining the intention of the driver to start the vehicle such as, for example, the amount of depression of the brake pedal equal to or smaller than a predetermined value (for example, the amount of depression being zero), the amount of depression of the accelerator pedal equal to or larger than a predetermined value (for example, the amount of depression of ten percent or more with respect to zero amount of depression) and a state of the battery 21 for supplying the electric power to the sensors provided to the engine 1 such as the intake-air temperature sensor 3.

When the result of determination in S105 is Yes, the operation proceeds to S106 because the restart requirement is satisfied. In S106, restart control means described below is executed, and the rotation speed Ne of the engine 1 computed by the rotation-speed computation means at the time of satisfaction of the restart requirement is stored as a restart request Nereq in the RAM 22 included in the ECU 22. The restart request Nereq is stored in the RAM 22D until the execution of the restart control means described below is terminated, and is erased from the RAM 22D when the execution of the restart control means is terminated. On the other hand, when the result of determination in S105 is No, at least one condition of the restart requirement is not satisfied because the brake pedal is currently depressed or the like. Therefore, the operation returns so as to maintain the automatically stopped state of the engine 1.

Figure 3:
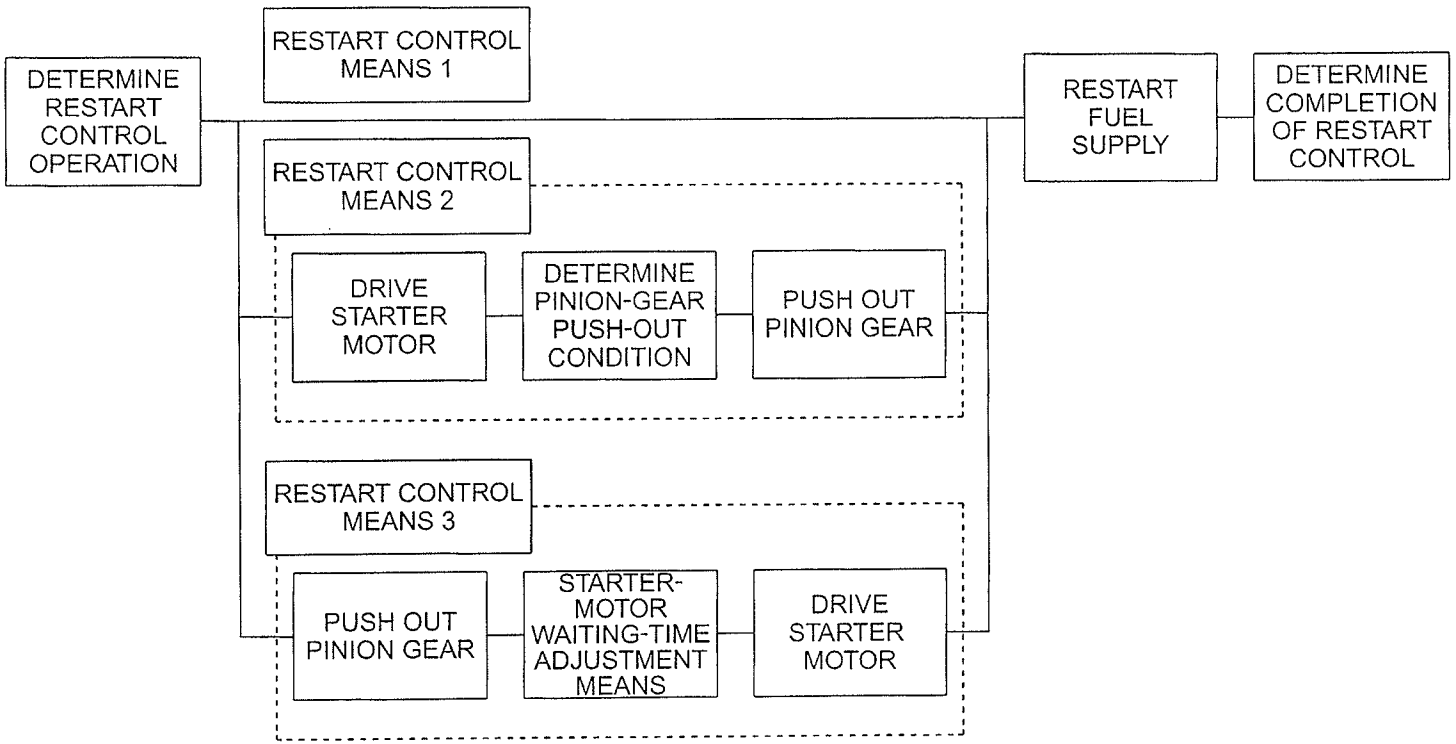
FIG. 3 is a block diagram illustrating an operation of restart control means of the automatic stop/restart device for the internal combustion engine, according to Embodiment 1 of the present invention.
Figure 4:
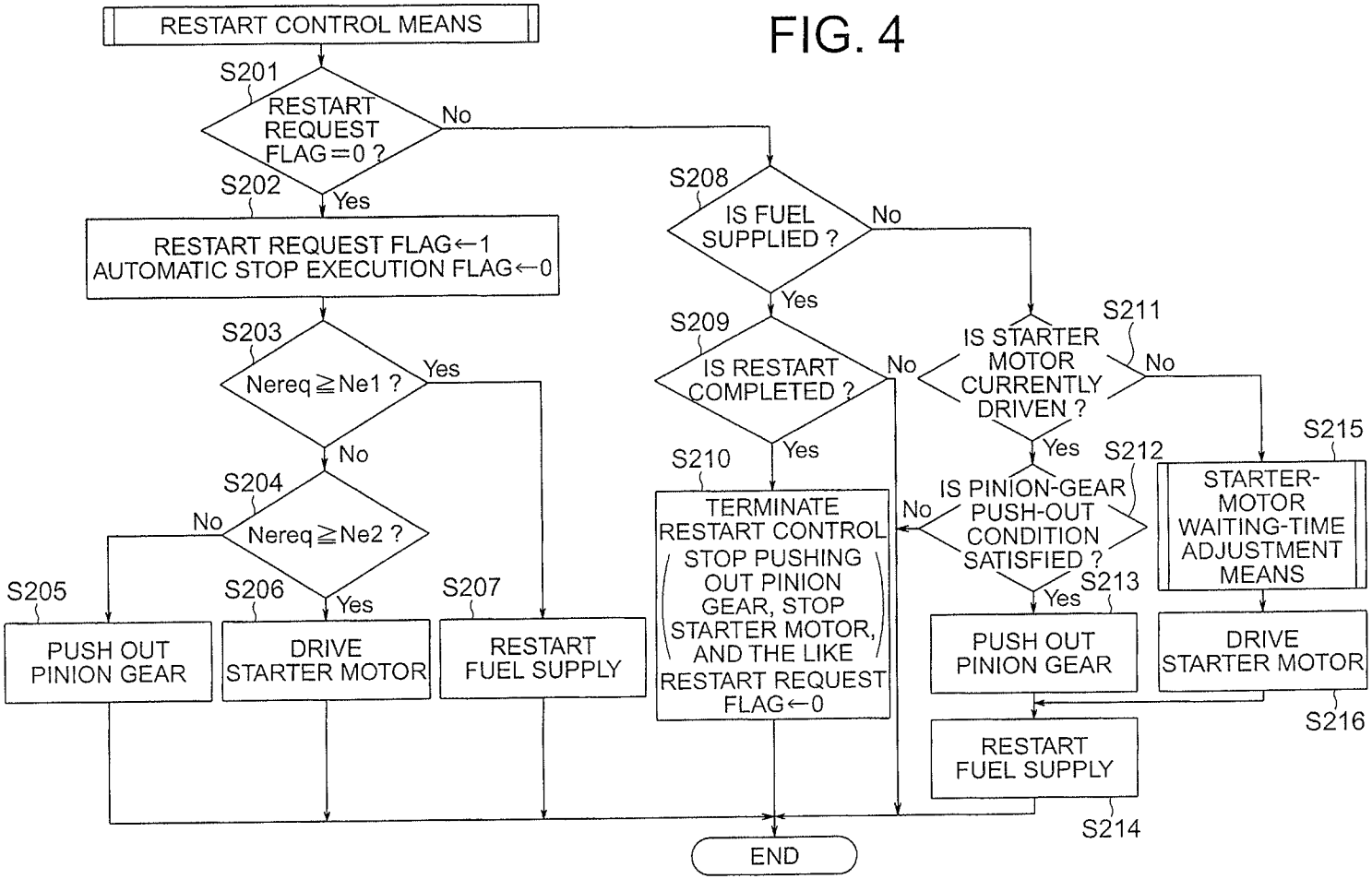
FIG. 4 is a flowchart illustrating the operation of the restart control means of the automatic stop/restart device for the internal combustion engine, according to Embodiment 1 of the present invention.

As described above, the automatic stop and restart of the engine 1 is performed. Next, the restart control means executed in S106 is described. The restart control means according to Embodiment 1 of the present invention performs the restart control in a flow of a block diagram of FIG. 3. First, in response to the restart request Nereq obtained when the restart requirement is satisfied in S105 described above, restart control operation determination is performed. The restart control operation determination is described below. According to the result of the restart control operation determination, "restart control means 1 (restart control program 1)", "restart control means 2 (restart control program 2)", or "restart control means 3 (restart control program 3") is executed. The restart control means 1 only restarts the fuel supply so as to determine the completion of the restart control. The restart control means 2 drives the starter motor, determines a pinion-gear push-out condition, and pushes out the pinion gear to restart the fuel supply so as to determine the completion of the restart control. The restart control means 3 pushes out the pinion gear, adjusts a waiting time of the starter motor (starter-motor waiting-time adjustment means), and drives the starter motor to restart the fuel supply so as to determine the completion of the restart control. Next, the restart control means is described. A flowchart of the restart control means is illustrated in FIG. 4.

First, in S201, a value of the restart request flag is determined. The restart control means illustrated in FIG. 4 is executed only after the restart requirement is satisfied. Therefore, when the restart control means is executed for the first time, the restart request flag is not set. When the restart control means is executed for the second or subsequent time, the restart request flag is set in S202 described below. The result of determination in S201 is Yes when the restart control means is executed for the first time. Therefore, the processing proceeds to S202. On the other hand, when the restart control means is executed for the second or subsequent time, the restart request flag is set. Therefore, the result of determination in S201 is No, and the processing proceeds to S208 described below.

In S202, the restart control is performed for the first time as described above. Therefore, the restart request flag is set to 1, whereas the automatic stop execution flag is set to zero. Then, the processing proceeds to S203. In S203 and S204, the restart request Nereq is compared with a predetermined rotation speed Ne1 and a predetermined rotation speed Ne2, respectively. The determinations performed in S203 and S204 correspond to the restart control operation determination illustrated in the block diagram of FIG. 3. In S203, the restart request Nereq corresponding to the rotation speed Ne of the engine 1, which is stored when the restart requirement is satisfied, is read from the RAM 22D included in the ECU 22 so as to be compared with the first predetermined rotation speed Ne1.

When the automatic stop requirement of the engine 1 is satisfied, various types of automatic stop control are executed. As a result, the rotation speed Ne of the engine 1 gradually reduces while the engine 1 is rotating by inertia. However, the starter 15 is always not required to be driven for the restart of the engine 1 over the entire time period in which the engine 1 comes into a stopped state. The rotation speed Ne has a lower limit value at which the engine 1 can be restarted only by restarting the fuel supply from the fuel injection valve 12 to the engine 1. Specifically, when the restart requirement is satisfied before the rotation speed becomes equal to the lower limit value, the recovery of the engine 1 is performed in the same manner as that of recovery after general fuel-cut and therefore, the starter 15 is not required to be driven. As the determination of whether or not the starter 15 is to be driven, the lower limit rotation speed is set as the first predetermined rotation speed Ne1. Then, the restart request Nereq and the first predetermined rotation speed Ne1 are compared with each other in S203. The first predetermined rotation speed Ne1 is set to, for example, 550 r/min and is prestored in the ROM 22C included in the ECU 22.

When the result of determination in S203 is Yes, the restart request Nereq is equal to or higher than the first predetermined rotation speed Ne1, specifically, the engine can be restarted only by the fuel supply from the fuel injection valve 12 and therefore, the starter 15 is not required to be driven. Thus, the restart control means 1 illustrated in FIG. 3 is executed, and the processing proceeds to S207. When the result of determination in S203 is No, the restart requirement is satisfied at a rotation speed at which it is difficult to restart the engine 1 only by the fuel supply from the fuel injection valve 12. Therefore, the processing proceeds to S204.

In S207, the fuel supply from the fuel injection valve 12 is restarted. Then, after the restart control means is terminated, the processing returns. When the processing proceeds to S204, the restart request Nereq and the second predetermined rotation speed Ne2 are compared with each other.

When the rotation speed Ne of the engine 1 becomes smaller than the first predetermined rotation speed Ne1, it becomes difficult to restart the engine 1 only by the fuel injection from the fuel injection valve 12. Therefore, the restart of the engine 1 needs the assist of the starter 15. However, if the pinion gear 17 is pushed out by the pinion-gear push-out device 18 without driving the starter motor 19 by the starter-motor driving device 20, a difference (Ne−Nm) between a rotation speed of the ring gear 16 (hereinafter, referred to as "rotation speed Ne of the engine 1 (rotation speed of the ring gear 16)" because the rotation speed of the ring gear 16 is equivalent to the rotation speed Ne of the engine 1) connected to the crankshaft and a rotation speed Nm of the pinion gear 17 is large. Therefore, it is difficult for the pinion gear 17 and the ring gear 16 to come into meshing engagement. Thus, when the restart requirement is satisfied, the starter motor 19 is first driven by the starter-motor driving device 20 to rotationally drive the pinion gear 17. Thereafter, the pinion gear 17 is pushed out by the pinion-gear push-out device 18. By the aforementioned operation, the difference between the rotation speed Nm of the pinion gear 17 and the rotation speed Ne of the engine 1 (rotation speed of the ring gear 16) can be reduced to allow the meshing engagement between the pinion gear 17 and the ring gear 16. Specifically, a lower limit rotation speed at which the starter 15 can be operated in the order of the driving of the starter motor 19 and the pushing of the pinion gear 17 is set as the second predetermined rotation speed Ne2. The second predetermined rotation speed Ne2 is set to, for example, 250 r/min, and is prestored in the ROM 22C included in the ECU 22.

The restart request Nereq and the second predetermined rotation speed Ne2 are compared with each other in S204. When the result of determination in S204 is Yes, the processing proceeds to S206 so that the starter motor 19 is first driven by the starter-motor driving device 20 and the pinion gear 17 is then pushed out by the pinion-gear push-out device 18 to assist the restart of the engine 1. On the other hand, when the result of determination in S204 is No, the processing proceeds to S205 so that the pinion gear 17 is first pushed out and the starter motor 19 is then driven to assist the restart of the engine 1. When the processing proceeds to S206, the restart control means 2 illustrated in FIG. 3 is executed. When the processing proceeds to S205, the restart control means 3 illustrated in FIG. 3 is executed.

In S205, the pinion gear 17 is pushed out by the pinion-gear push-out device 18. Then, the restart control means is terminated, and the processing returns. On the other hand, when the operation proceeds to S206, the starter motor 19 is driven by the starter-motor driving device 20 to start the rotational driving of the pinion gear 17. Then, the restart control means is terminated, and the processing returns.

When the restart control means is executed for the second time, the restart request flag is set because the restart control means is currently executed. Therefore, the result of determination in S201 is No, and the operation proceeds to S208. When the processing proceeds to S208, whether or not the fuel supply has been performed is determined. When the result of determination in S208 is Yes, the fuel supply is restarted in S207 described above or in S214 described below. Therefore, the processing proceeds to S209 where whether or not the restart has been completed is determined. On the other hand, when the result of determination in S208 is No, the fuel supply cannot be restarted yet in a current state. Therefore, the processing proceeds to S211.

In S209, whether or not the restart has been completed is determined. The result of determination is Yes when, for example, it is determined that the rotation speed Ne of the engine 1 is equal to or higher than a predetermined rotation speed. As the predetermined rotation speed, different values are stored in the ROM 22C included in the ECU 22 according to the restart request Nereq. The predetermined rotation speed is set to, for example, 850 r/min when the restart request Nereq is equal to or higher than the first predetermined rotation speed Ne1 and is set to, for example, 500 r/min when the restart request Nereq is lower than the first predetermined rotation speed Ne1.

When the result of determination in S209 is Yes, it is determined that the restart of the engine 1 has been completed, for example, the rotation speed Ne of the engine 1 is equal to or higher than the aforementioned predetermined rotation speed. Therefore, the processing proceeds to S210 where the restart control is terminated. As the termination of the restart control, the amount of control of the throttle valve 6 is set to a normal amount of control. However, an operation of stopping the driving of the starter 15 is not performed in this case because the starter 15 is not driven when the restart request Nereq is equal to or higher than the first predetermined rotation speed Ne1. In addition, various types of control such as the transition of a state of the clutch from the open state to the engaged state, which are executed during the automatic stop and restart operation, are terminated. Further, when the restart request Nereq is lower than the first predetermined rotation speed Ne1, the starter 15 is driven to execute the restart control means. Therefore, the pushing of the pinion gear 17 by the pinion-gear push-out device 18 is terminated. In addition, the driving of the starter motor 19 by the starter-motor driving device 20 is terminated. Moreover, the amount of control of the throttle valve 6 is set to the normal amount of control. Further, various types of control such as the transition of the state of the clutch from the open state to the engaged state, which are executed during the automatic stop and restart operation, are terminated. Then, the restart request flag is set to 0, and the restart control means is terminated. Then, the processing returns.

When the result of determination in S209 is No, the restart of the engine 1 has not been completed yet, for example, the rotation speed Ne of the engine 1 has not become equal to or higher than the predetermined rotation speed. Therefore, the processing returns.

When the processing proceeds to S211 because the result of determination in S208 is No, it is then determined whether or not the starter motor 19 is currently driven. The determination is equivalent to the determination performed in response to the result of comparison between the restart request Nereq and the second predetermined rotation speed Ne2, which is performed in S204. When the result of determination is Yes, specifically, when the starter motor 19 is currently driven, the processing proceeds to S212. On the other hand, when the result of determination is No, specifically, when the pinion gear 17 is pushed out, the processing proceeds to S215. The determination performed in S211 is equivalent to that performed in S204 which is performed when the restart control means is executed for the first time. Thus, there is no problem to replace the determination performed in S211 by the comparison and determination between the restart request Nereq and the second predetermined rotation speed Ne2.

Figure 5:
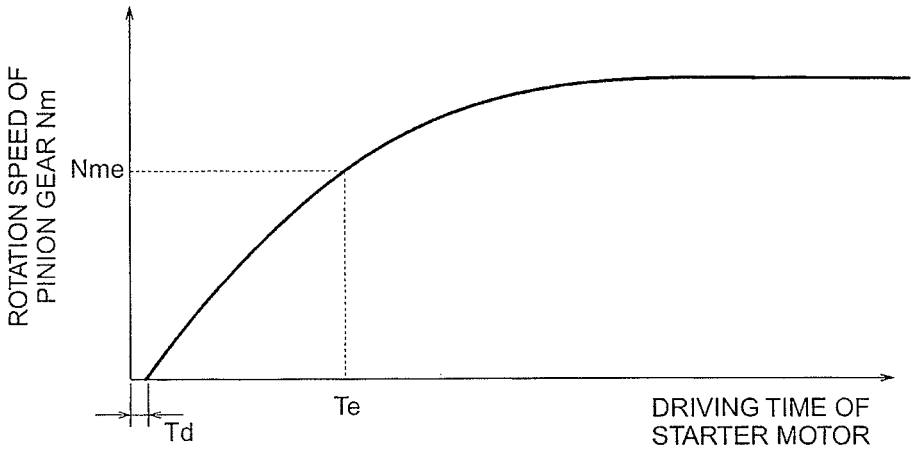
FIG. 5 is a graph showing a starter-motor driving characteristic of the automatic stop/restart device for the internal combustion engine, according to Embodiment 1 of the present invention.

When the processing proceeds to S212 because the result of determination in S211 is Yes, whether or not a pinion-gear push-out condition is satisfied is then determined because the starter motor 19 is driven by the starter-motor driving device 20 to start the rotational driving of the pinion gear 17. The rotation speed Ne of the engine 1 (rotation speed of the ring gear 16) reduces with the elapse of time while the rotation speed of the engine 1, which is lowered while the engine 1 is rotating by inertia, is prevented from fluctuating by the execution of the automatic stop control such as the limitation of the amount of control of the throttle valve 6. On the other hand, the rotation speed Nm of the pinion gear 17, which is not in meshing engagement with the ring gear 16, increases with the elapse of time because a driving time of the starter motor 19 by the starter-motor driving device 20 and the rotation speed Nm of the pinion gear 17 have a relation illustrated in FIG. 5. The relation between the driving time of the starter motor 19 and the rotation speed Nm of the pinion gear 17 (starter-motor driving characteristic) illustrated in FIG. 5 is previously obtained by an experiment or the like and is stored in the ROM 22C included in the ECU 22. Therefore, the rotation speed Nm of the pinion gear 17 can be obtained by measuring the driving time of the starter motor 19. Thus, the difference (Ne−Nm) between the rotation speed Ne of the engine 1 and the rotation speed Nm of the pinion gear 17 can be calculated by using the driving time of the starter motor 19.

Specifically, after the driving time of the starter motor 19 becomes equal to a predetermined time, the difference between the rotation speed Ne of the engine 1 (rotation speed of the ring gear 16) and the rotation speed Nm of the pinion gear 17 becomes equal to a difference in rotation speed at which the ring gear 16 and the pinion gear 17 come into meshing engagement and therefore, the pinion gear 17 can be pushed out by the pinion-gear push-out device 18. Hence, whether or not the driving time of the starter motor 19 becomes equal to or longer than the predetermined driving time is determined in S212 as the pinion-gear push-out condition.

When the result of determination in S212 is Yes, specifically, when the driving time of the starter motor 19 is equal to or longer than the predetermined driving time, the difference between the rotation speed Ne of the engine 1 (rotation speed of the ring gear 16) and the rotation speed Nm of the pinion gear 17 is equal to the difference in rotation speed at which the ring gear 16 and the pinion gear 17 come into meshing engagement. Therefore, the processing proceeds to S213. When the result of determination in S212 is No, the driving time of the starter motor 19 is shorter than the predetermined time, specifically, the difference between the rotation speed Ne of the engine 1 (rotation speed of the ring gear 16) and the rotation speed Nm of the pinion gear 17 is not equal to the difference in rotation speed at which the ring gear 16 and the pinion gear 17 come into meshing engagement. Thus, the restart control means is terminated, and then the processing returns.

In S213, after the pinion gear 17 is pushed out by the pinion-gear push-out device 18, the processing proceeds to S214 where the fuel supply from the fuel injection valve 12 to the combustion chamber of the engine 1 is restarted. Thereafter, the restart control means is terminated, and the processing returns.

When the result of determination in S211 is No, the processing proceeds to S215. When the processing proceeds to S215, the restart request Nereq is lower than the second predetermined rotation speed Ne2. Therefore, the pinion gear 17 is currently pushed by the pinion-gear push-out device 18, and the starter motor 19 is not driven. Hence, the pinion gear 17 is not rotationally driven. Moreover, the difference between the rotation speed Ne of the engine 1 (rotation speed of the ring gear 16) and the rotation speed Nm of the pinion gear 17 is large because the pinion gear 17 is not rotationally driven. Therefore, it is difficult to bring the ring gear 16 and the pinion gear 17 into meshing engagement with each other. Accordingly, starter-motor waiting-time adjustment means (starter-motor waiting-time adjusting program) is executed in S215. The starter-motor waiting-time adjustment means is executed for driving the starter motor 19 to rotationally drive the pinion gear 17 while the pinion gear 17 is being pushed out so that the ring gear 16 and the pinion gear come into meshing engagement.

Figure 6:
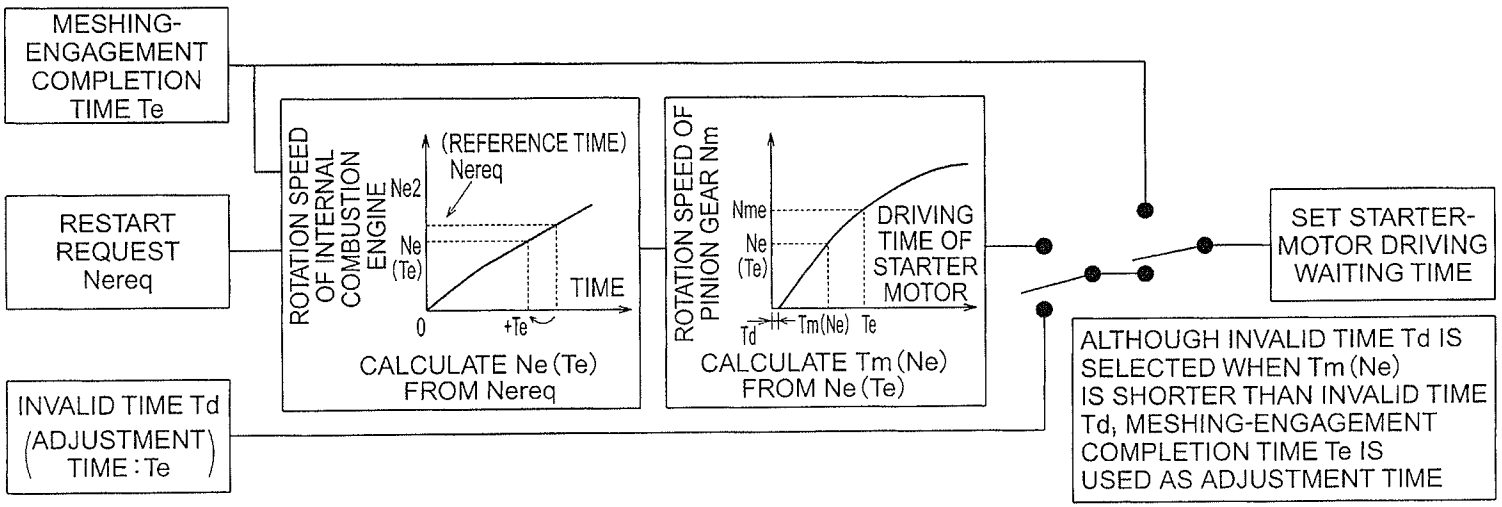
FIG. 6 is a block diagram illustrating an operation of starter-motor waiting-time adjustment means of the automatic stop/restart device for the internal combustion engine, according to Embodiment 1 of the present invention.

The starter-motor waiting-time adjustment means executed in S215 is now described. A meshing-engagement completion time Te, for example, about 0.06 seconds is required to push out and bring the pinion gear 17 into meshing engagement with the ring gear 16 because there is a distance between a stop position of the pinion gear 17 and the ring gear 16. Moreover, an invalid time Td, for example, about 0.01 second is required to rotationally drive the pinion gear 17 from the start of the driving of the starter motor 19 by the starter-motor driving device 20. If the difference between the rotation speed Nm of the pinion gear 17, which is achieved by driving the starter motor 19, and the rotation speed Ne of the engine 1 (rotation speed of the ring gear 16) becomes equal to a difference in rotation speed at which the pinion gear 17 and the ring gear 16 come into meshing engagement within a time period between the invalid time Td and the meshing-engagement completion time Te, the ring gear 16 and the pinion gear 17 can be brought into meshing engagement by driving the starter motor 19 while the pinion gear 17 is being pushed out. Therefore, a waiting time from the start of the pushing of the pinion gear 17 to the start of the driving of the starter motor 19 is set. An operation of the starter-motor waiting-time adjustment means is as illustrated in FIG. 6. In FIG. 6, the left graph corresponds to FIG. 7, whereas the right graph corresponds to FIG. 5. As illustrated in FIG. 6, the starter-motor driving waiting time is calculated by using parameters such as the meshing-engagement completion time Te, the engine rotation speed Nereq obtained when the restart is requested, and the invalid time Td.

Figure 7:
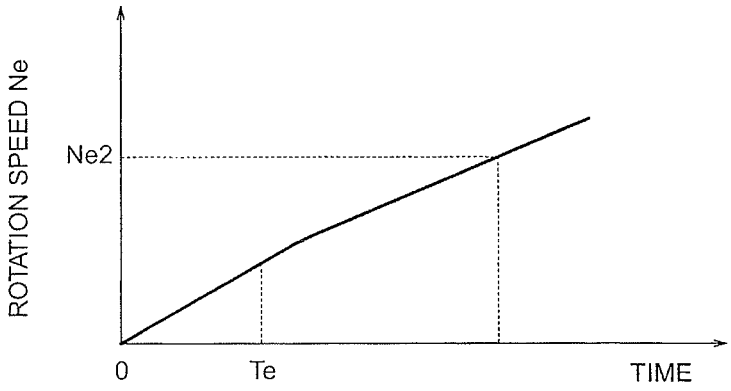
FIG. 7 is a graph showing a rotation-speed reduction characteristic of the internal combustion engine in the automatic stop/restart device for the internal combustion engine, according to Embodiment 1 of the present invention.

First, the rotation speed Ne of the engine 1 at the end of the meshing-engagement completion time Te is obtained from the meshing-engagement completion time Te and the restart request Nereq. A time required for the engine 1 to stop from a state in which the engine 1 rotates at a rotation speed lower than the second predetermined rotation speed Ne2 has a relation of an internal combustion engine rotation speed reduction characteristic as shown in FIG. 7, which is obtained by an experiment or the like, and is prestored in the ROM 22C included in the ECU 22. If the restart requirement Nereq, the relation shown in FIG. 7, and the meshing-engagement completion time Te are used as shown in the left part of FIG. 6, the rotation speed Ne of the engine 1 at the end of the meshing-engagement completion time Te based on time corresponding to the restart request Nereq as reference time can be calculated.

The rotation speed Nm of the pinion gear 17 until the end of the meshing-engagement completion time Te has a relation between the driving time of the starter motor 19 and the rotation speed Nm of the pinion gear 17, which is shown in FIG. 5. Therefore, the rotation speed Nm of the pinion gear 17 can be calculated from the driving time of the starter motor 19. In the same manner, a time required for the rotation speed Nm of the pinion gear 17 to reach the rotation speed which is required to achieve the meshing engagement can also be calculated as shown in the right part of FIG. 6. Moreover, the invalid time Td is calculated from the relation shown in FIG. 5. As described above, the relation shown in FIG. 5 is also prestored in the ROM 22C included in the ECU 22.

Therefore, the rotation speed Ne(Te) of the engine 1 from the start of the pushing of the pinion gear 17 to the end of the meshing-engagement completion time Te is calculated from the relation illustrated in FIG. 7 using the time at which the restart requirement is satisfied (time corresponding to the restart request Nereq) as the reference time. When the rotation speed Ne(Te) of the engine 1 and the relation shown in FIG. 5 are used, the starter-motor driving time Tm(Ne) required for the rotation speed of the pinion gear 17 to reach the rotation speed Ne(Te) of the engine 1 in the case where the pinion gear 17 is pushed out and the starter motor 19 is driven after the restart requirement is satisfied can be calculated.

When the starter-motor driving time Tm(Ne) is equal to or shorter than the meshing-engagement completion time Te, the ring gear 16 and the pinion gear 17 can be brought into meshing engagement with each other by driving the starter motor 19 while the pinion gear 17 is being pushed out or simultaneously with the start of the pushing of the pinion gear 17. However, the invalid time Td exists in which the pinion gear 17 cannot be rotationally driven even if the starter motor 19 is driven, as shown in FIG. 5. When the starter-motor driving time Tm(Ne) is equal to or shorter than the invalid time Td, the restart request Nereq at the time of satisfaction of the restart requirement is sufficiently small. Therefore, the meshing engagement can be achieved even without driving the starter motor 19. When the starter motor 19 is driven, there is a fear that the meshing engagement is achieved in a state in which the rotation speed Nm of the pinion gear 17 exceeds the rotation speed Ne of the engine 1 (rotation speed of the ring gear 16). Therefore, the driving of the starter motor 19 is not allowed. The computation and determination described above are performed in S215.

Figure 8:
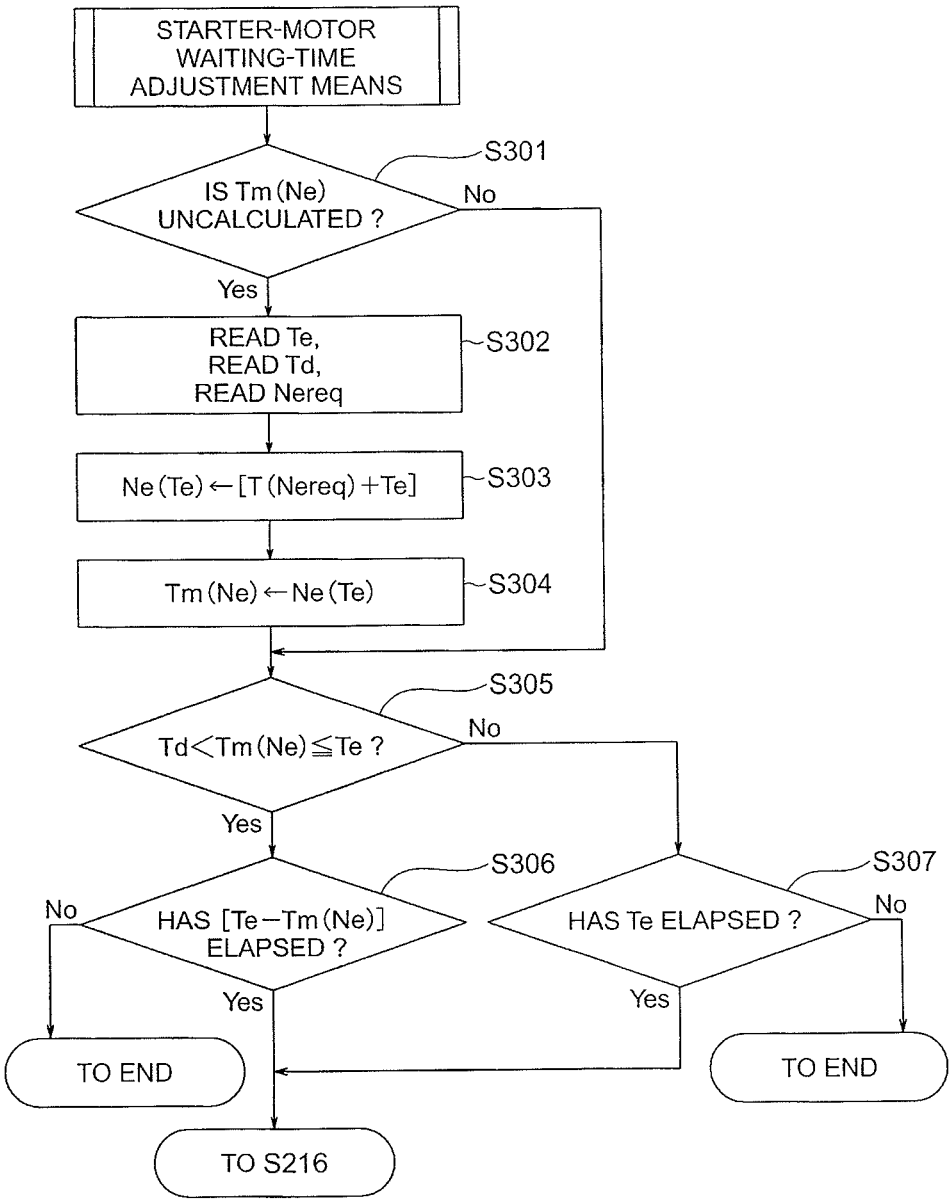
FIG. 8 is a flowchart illustrating the operation of the starter-motor waiting-time adjustment means of the automatic stop/restart device for the internal combustion engine, according to Embodiment 1 of the present invention.

When the starter-motor waiting-time adjustment means is executed in S215, whether or not the starter-motor driving time Tm(Ne) is uncalculated is first determined in S301 of FIG. 8. The starter-motor driving time Tm(Ne) is calculated according to S303 and S304 described below and therefore, it is apparent that the starter-motor driving time Tm(Ne) is not calculated yet in the first routine of the starter-motor waiting-time adjustment means. Therefore, the result of determination in S301 is Yes. Then, the processing proceeds to S302. On the other hand, when the starter-motor waiting-time adjustment means is executed for the second or subsequent time, the starter-motor driving time Tm(Ne) is already calculated. Therefore, the operation proceeds to S305 described below.

In S302, the meshing-engagement completion time Te and the invalid time Td, which are prestored in the ROM 22C included in the ECU 22, and the restart request Nereq stored in the RAM 22D are read. Then, the processing proceeds to S303.

Next, in S303, the rotation speed Ne(Te) of the engine 1 at the end of the meshing-engagement completion time Te is calculated by using the relation shown in the left part of FIG. 6 (relation of FIG. 7) using the time corresponding to the thus read restart request Nereq as the reference time. Then, the processing proceeds to S304.

Next, in S304, the starter-motor driving time Tm(Ne) which corresponds to the time required for the restart request Nereq to reach the rotation speed Ne(Te) of the engine 1 at the end of the meshing-engagement completion time Te is calculated by using the relation shown in the right part of FIG. 6 (relation of FIG. 5). Then, the processing proceeds to S305.

In S305, whether or not the starter-motor driving time Tm(Ne) is present between the meshing-engagement completion time Te and the invalid time Td, which are read in S302. When the starter-motor driving time Tm(Ne) is present between the meshing-engagement completion time Te and the invalid time Td, the ring gear 16 and the pinion gear 17 can be brought into meshing engagement by driving the starter motor 19 while the pinion gear 17 is being pushed out. When the result of determination in S305 is Yes, the processing proceeds to S306. On the other hand, when the result of determination in S305 is No, the processing proceeds to S307.

In S306, a time difference (Te−Tm(Ne)) between the meshing-engagement completion time Te and the starter-motor driving time Tm(Ne) is calculated, and it is determined whether or not the calculated time difference has elapsed. The time difference between the meshing-engagement completion time Te and the starter-motor driving time Tm(Ne) corresponds to the driving waiting time for the starter motor 19. When the result of determination in S306 is Yes, the driving waiting time for the starter motor 19 has elapsed. Therefore, the processing proceeds to S216 of the restart control means. In S216, the starter motor 19 is driven by the starter-motor driving device 20. Then, the processing proceeds to S214 where the fuel supply from the fuel injection valve 12 is restarted. Then, the restart control means is terminated. When the result of determination in S306 is No, the driving waiting time for the starter motor 19 has not elapsed. Therefore, the starter-motor waiting-time adjustment means is terminated. At the same time, the restart control means is terminated. Then, the processing returns.

On the other hand, when the result of determination is No in S305, the restart request Nereq is low. Therefore, the ring gear 16 and the pinion gear 17 are brought into meshing engagement in a state in which the rotation speed Ne of the engine 1 is sufficiently reduced and the rotation of the engine 1 is nearly stopped. Thus, even if the starter motor 19 is driven, the meshing engagement is completed immediately after the start of the driving of the starter motor 19. In addition, if the starter motor 19 is driven, the ring gear 16 and the pinion gear 17 are brought into meshing engagement in a state in which the rotation speed Nm of the pinion gear 17 exceeds the rotation speed Ne of the engine 1 (rotation speed of the ring gear 16). Therefore, the meshing engagement is more likely to fail. To cope with the aforementioned problems, in S307, whether or not a time from the start of the pushing of the pinion gear 17 is equal to or longer than the meshing-engagement completion time Te is determined so as to inhibit the driving of the starter motor 19 until the end of the meshing-engagement completion time Te. In this case, the meshing-engagement completion time Te corresponds to the driving waiting time for the starter motor 19.

In S307, whether or not the time from the start of the pushing of the pinion gear 17 is equal to or longer than the meshing-engagement completion time Te is determined. When the time from the start of the pushing of the pinion gear 17 is equal to or longer than the meshing-engagement completion time Te, the result of determination in S307 is Yes. Therefore, it is determined that the meshing engagement between the pinion gear 17 and the ring gear 16 has been completed. Thus, the processing proceeds to S216 of the restart control means where the starter motor 19 is driven by the starter-motor driving device 20. Then, the processing proceeds to S214 where the fuel supply from the fuel injection valve 12 is restarted. Subsequently, the restart control means is terminated, and the processing returns. When the result of determination in S307 is No, the time from the start of the pushing of the pinion gear 17 is shorter than the meshing-engagement completion time Te. Therefore, it is determined that the meshing engagement between the pinion gear 17 and the ring gear 16 has not been completed, and the restart control means is terminated.

Figure 9:
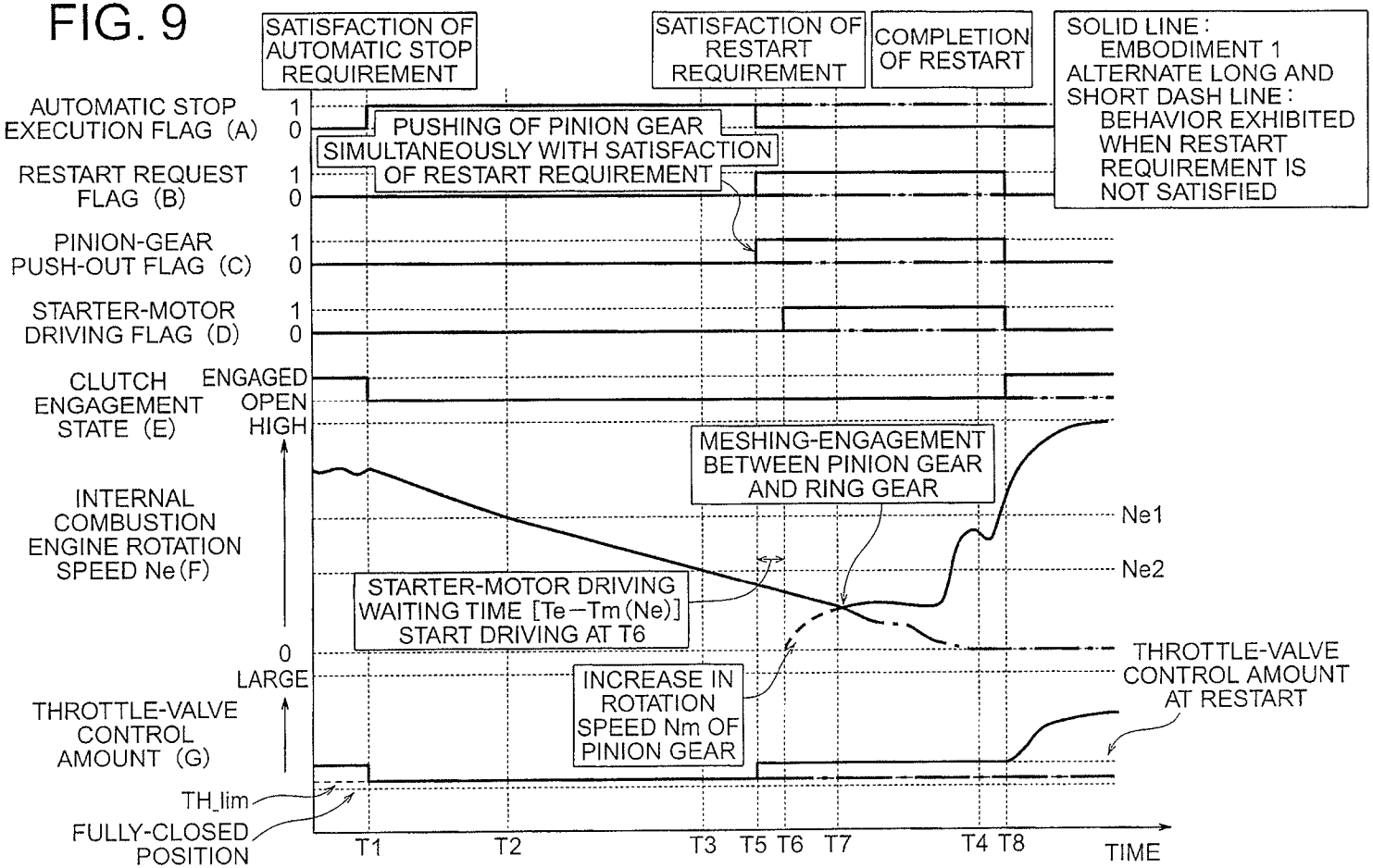
FIG. 9 is a timing chart illustrating behaviors of the automatic stop/restart device for the internal combustion engine according to Embodiment 1 of the present invention, which are exhibited when a restart requirement (second predetermined rotation speed Ne2>restart request Nereq) is satisfied while the internal combustion engine is rotating by inertia.

An operation of the automatic stop/restart device for the internal combustion engine according to Embodiment 1 from the automatic stop control to the restart control, which is described above, is described referring to timing charts of FIGS. 9 to 12. FIG. 9 is a timing chart from the start of the automatic stop control to the end of the restart control and shows the automatic stop execution flag (A), the restart request flag (B), the pinion-gear push-out flag (C), the starter-motor driving flag (D), a clutch engagement state (E), the internal combustion engine rotation speed Ne (F), and the throttle-valve control amount (G). In the part (F) of the internal combustion engine rotation speed Ne, the solid line indicates the rotation speed obtained when the restart control means is executed, whereas the alternate long and short dash line indicates the rotation speed obtained when the restart control means is not executed.

A behavior of the rotation speed Ne of the engine 1 exhibited when the engine 1 is automatically stopped in the case where the restart requirement is not satisfied in FIGS. 9 to 12 is first described. When the automatic stop requirement is satisfied at time T1, the fuel supply from the fuel injection valve 12 is stopped. At the same time, the throttle-valve control amount (G) is limited to a predetermined limit amount TH_lim. Moreover, the automatic stop control such as an operation of opening the clutch is performed as the clutch engagement state (E), and therefore the automatic stop execution flag (A) is set to 1. A fluctuation in the rotation speed Ne of the engine 1 is reduced by limiting the throttle-valve control amount (G) and performing the operation of opening the clutch as the clutch engagement state (E). The rotation speed Ne of the engine 1 is reduced at a uniform rate. After time T2, the rotation speed Ne of the engine 1 becomes equal to or lower than the first predetermined rotation speed Ne1. After time T3, the rotation speed Ne of the engine 1 becomes equal to or lower than the second rotation speed Ne2. Then, at time T4, the engine 1 is completely stopped.

Figure 10:
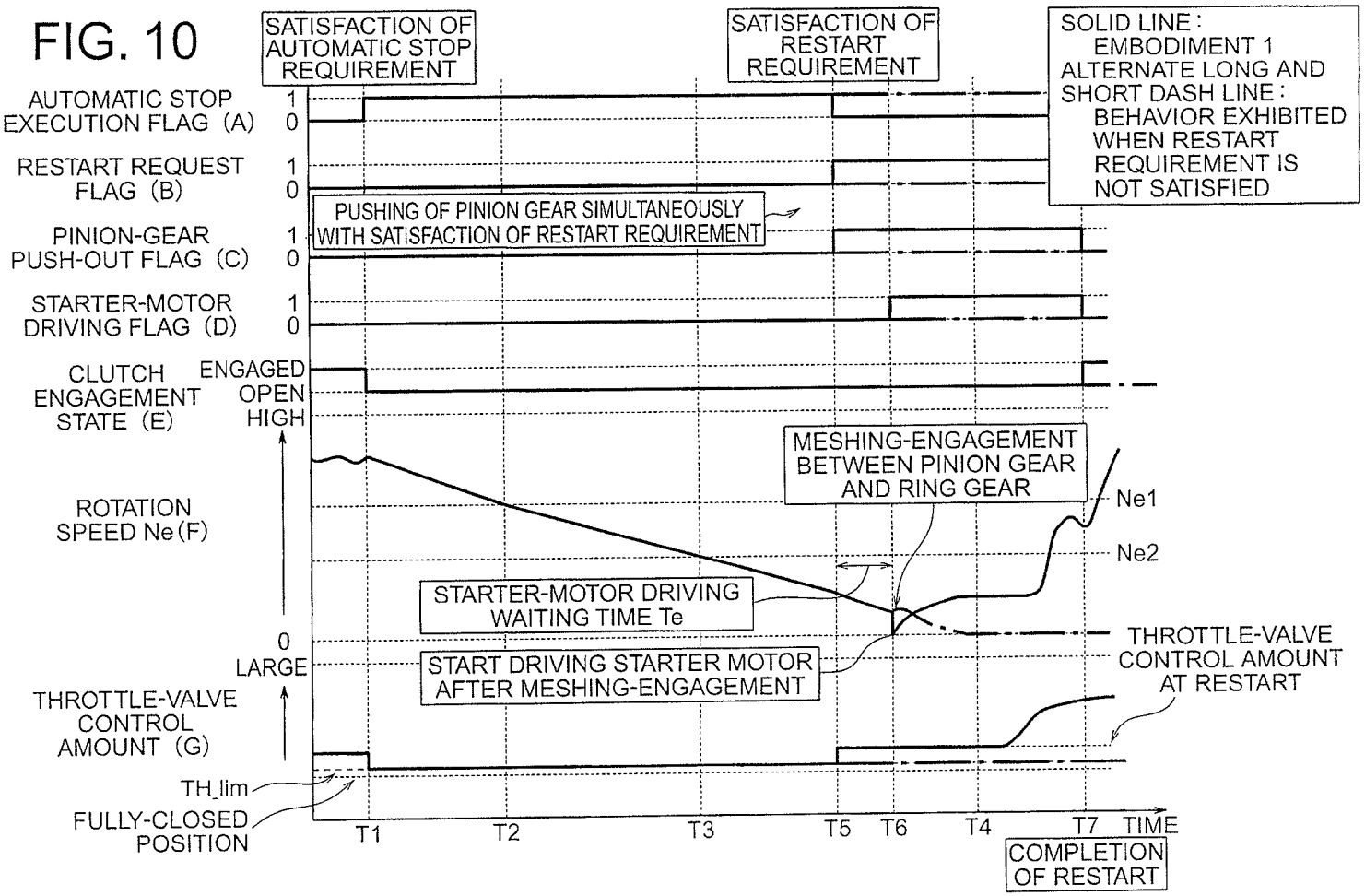
FIG. 10 is another timing chart illustrating the behaviors of the automatic stop/restart device for the internal combustion engine according to Embodiment 1 of the present invention, which are exhibited when the restart requirement (second predetermined rotation speed Ne2>restart request Nereq) is satisfied while the internal combustion engine is rotating by inertia.

The case where the starter-motor waiting-time adjustment means is operated in FIGS. 9 and 10, specifically, the restart control means 3 illustrated in FIG. 3 is operated is first described for the behavior of the rotation speed Ne of the engine 1 described above. First, when the automatic stop requirement is satisfied at time T1, the fuel supply from the fuel injection valve 12 is stopped. At the same time, the throttle-valve control amount (G) is limited to the predetermined limit amount TH_lim. Moreover, the automatic stop control such as the operation of opening the clutch is performed as the clutch engagement state (E), and the automatic stop execution flag (A) is set to 1.

The automatic stop control is continued because the restart requirement is satisfied neither at time T2 nor at time T3. Then, at time T5, the restart requirement is satisfied. When the restart requirement is satisfied by an operation of releasing the brake pedal and pressing down the accelerator pedal performed by the driver at time T5, the rotation speed Ne (F) of the engine 1 is lower than the first predetermined rotation speed Ne1 and the second predetermined rotation speed Ne2. Therefore, the pinion-gear push-out flag (C) is set to 1 so as to start the pushing of the pinion gear 17. At the same time, whether or not the driving of the starter motor 19 is to be started by the starter-motor waiting-time adjustment means before the end of the meshing-engagement completion time Te is determined.

First, FIG. 9 illustrates a behavior exhibited in the case where the driving of the starter motor 19 is started before the end of the meshing-engagement completion time Te. At time T6, the starter-motor driving flag (D) is set to 1 to start the driving of the starter motor 19. At the same time, the fuel supply is also restarted. Then, at time T7, the pinion gear 17 and the ring gear 16 are brought into meshing engagement. The engine 1 is accelerated by the starter 15. The combustion in the engine 1 is restarted because the fuel supply has been restarted. As a result, the rotation speed Ne of the engine 1 increases. At time T8, the restart is completed.

When it is determined that the restart is completed at time T8, the restart control means is terminated. The pinion-gear push-out flag (C) and the starter-motor driving flag (D) are set to zero to stop the driving of the starter 15. At the same time, the throttle-valve control amount (G) is set to a normal control amount. Moreover, the operation is switched to a normal operation such as an operation of bringing the clutch into engagement ((E) of FIG. 9). The restart requirement flag (B) is set to zero.

Next, in contrast to the case illustrated in FIG. 9, the case illustrated in FIG. 10 where the rotation speed Ne of the engine 1 at the time of satisfaction of the restart requirement is low is described. FIG. 10 is a timing chart illustrating a case where the starter motor 19 is not driven before the end of the meshing-engagement completion time Te and is driven after the end of the meshing-engagement completion time Te to perform the restart control in the case where the starter-motor driving waiting time is equal to or longer than the meshing-engagement completion time Te or equal to or shorter than the invalid time Td as the result of determination by the starter-motor waiting-time adjustment means. At time T5, the restart requirement is satisfied. As a result, the automatic stop execution flag (A) is set to zero, whereas the restart request flag (B) and the pinion-gear push-out flag (C) are set to 1, thereby starting the restart control. It is determined that the starter 19 is not to be driven as a result of determination by the starter-motor waiting-time adjustment means. Therefore, the driving of the starter motor 19 is started after the end of the meshing-engagement completion time Te.

At time T6, the meshing-engagement completion time Te starting with the pushing of the pinion gear ends. Therefore, it is determined that the meshing engagement is completed. Therefore, the starter motor 19 is driven to accelerate the engine 1. At the same time, the fuel supply is restarted. Thereafter, the combustion in the engine 1 is restarted by the increase in the rotation speed Ne of the engine 1 and the restart of the fuel supply. At time T7, the restart is completed.

When the restart is completed at time T7, the restart control means is terminated. Therefore, the pinion-gear push-out flag (C) and the starter-motor driving flag (D) are set to zero, whereas the throttle-valve control amount (G) is set to the normal control amount. The operation is switched to the normal operation such as the operation of bringing the clutch into engagement (part (E) of FIG. 10). The restart request flag (B) is set to zero.

Figure 11:
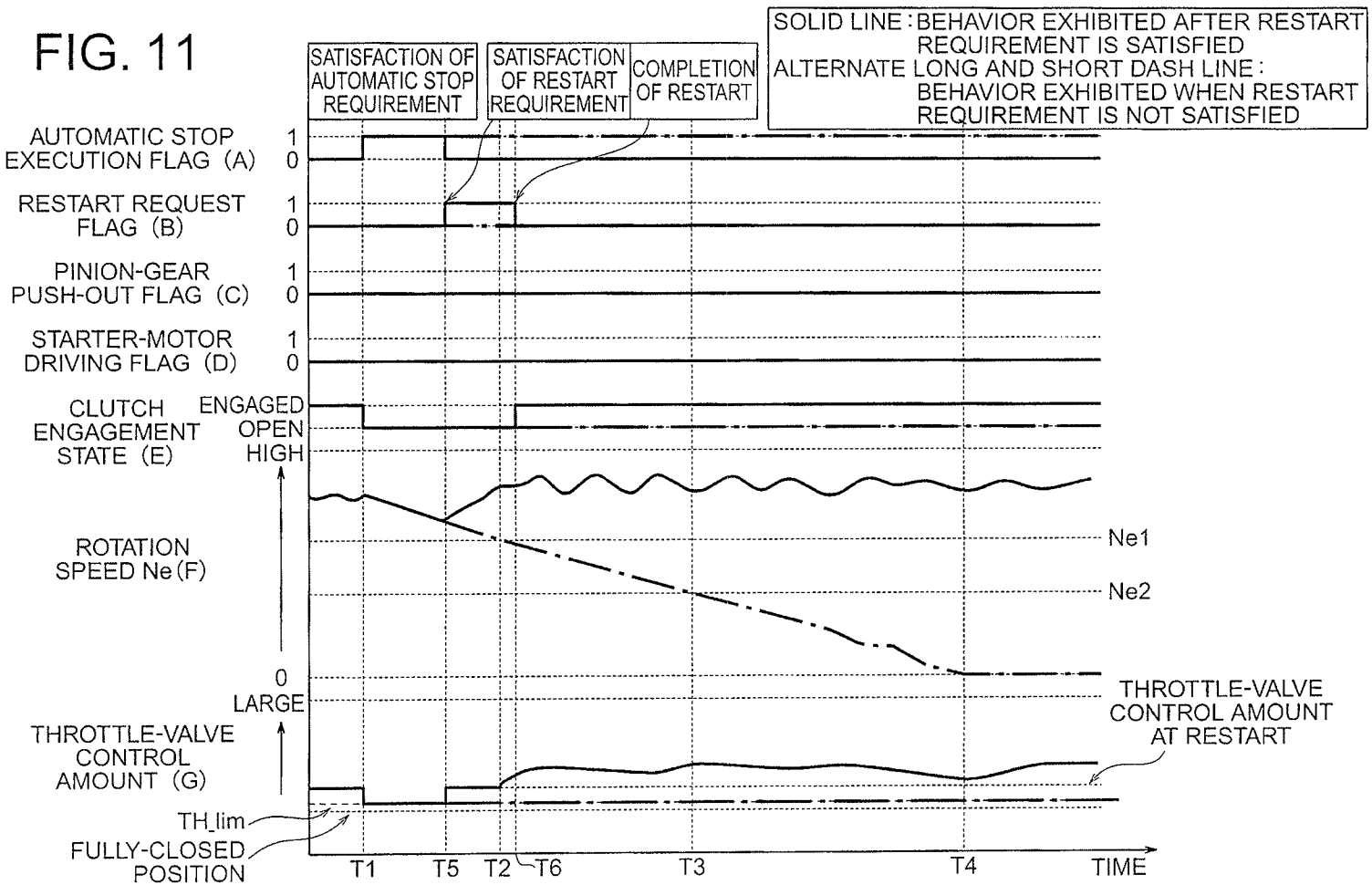
FIG. 11 is a further timing chart illustrating the behaviors of the automatic stop/restart device for the internal combustion engine according to Embodiment 1 of the present invention, which are exhibited when a restart requirement (restart request Nereq≥first predetermined rotation speed Ne1) is satisfied while the internal combustion engine is rotating by inertia.

Next, the restart control means 1 in which the restart is completed without driving the starter 15 is described. A timing chart is illustrated in FIG. 11. When the automatic stop requirement is satisfied at time T1, the fuel supply from the fuel injection valve 12 is stopped. At the same time, the throttle-valve control amount (G) is limited to the predetermined limit amount TH_lim. Moreover, the automatic stop control such as the operation of opening the clutch as the clutch engagement state (E) is performed, and therefore the automatic stop execution flag (A) is set to 1.

In FIG. 11, the restart requirement is satisfied by the release of the brake pedal and the depression of the accelerator pedal performed by the driver at time T5 between time T1 and time T2. At time T5, the rotation speed Ne (F) of the engine 1 is equal to or higher than the first predetermined rotation speed Ne1. Therefore, the starter 15 is not required to be driven at time T5. Accordingly, the fuel supply from the fuel supply valve 12 is restarted, while the throttle-valve control amount (G) is set to an opening degree for the restart. Moreover, the automatic stop execution flag (A) is set to 0, whereas the restart request flag (B) is set to 1.

By the restart of the fuel supply from the fuel injection valve 12, the combustion in the engine 1 is restarted to increase the rotation speed Ne of the engine 1, which is reduced until time T5. At time T6, it is determined that the restart is completed to terminate the restart control means. The throttle-valve control amount (G) is switched to the control amount according to the normal control. At the same time, the operation is switched to the normal operation such as the operation of bringing the clutch into engagement as the clutch engagement state (E). The restart request flag (B) is set to zero. The restart request Nereq is equal to or higher than the first predetermined rotation speed Net. Therefore, the starter 15 is not driven. The pinion-gear push-out flag (C) and the starter-motor driving flag (D) remain being zero.

Figure 12:
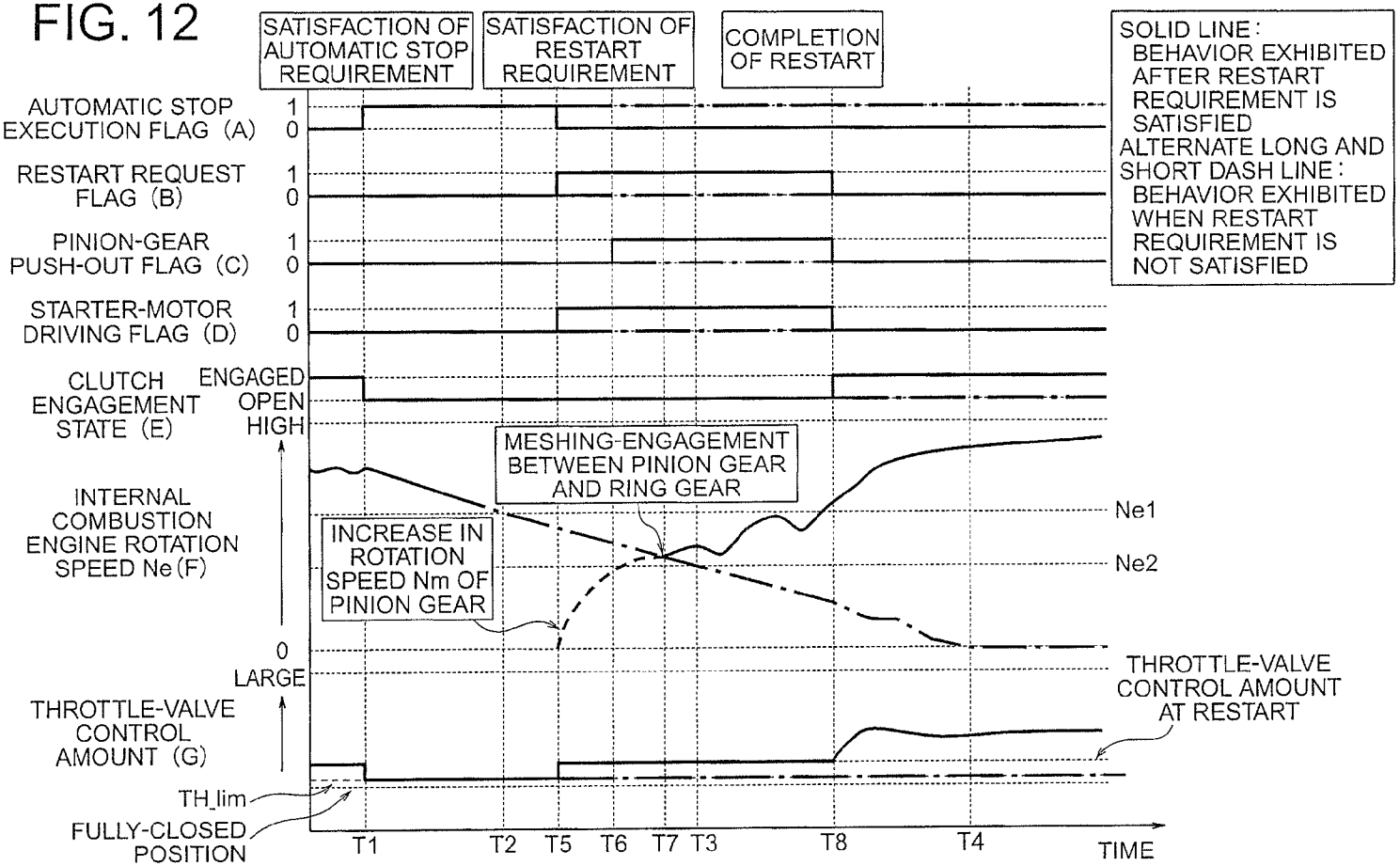
FIG. 12 is a further timing chart illustrating the behaviors of the automatic stop/restart device for the internal combustion engine according to Embodiment 1 of the present invention, which are exhibited when a restart requirement (first predetermined rotation speed Ne1>restart request Nereq≥second predetermined rotation speed Ne2) is satisfied while the internal combustion engine is rotating by inertia.

Next, FIG. 12 is described. FIG. 12 is a timing chart illustrating the case where the restart control is performed by the restart control means 2 in which the pinion gear 17 is pushed out after the starter motor 19 is driven because the rotation speed Ne of the engine 1 is high when the restart requirement is satisfied, in the automatic stop/restart device for the internal combustion engine according to Embodiment 1.

In FIG. 12, when the automatic stop requirement is satisfied at time T1, the fuel supply from the fuel injection valve 12 is stopped. At the same time, the throttle-valve control amount (G) is limited to the predetermined limit amount TH_lim. Moreover, the automatic stop control such as the operation of opening the clutch as the clutch engagement state (E) is performed, and therefore the automatic stop execution flag (A) is set to 1.

Next, at time T2, the restart requirement is not satisfied even though the rotation speed of the engine 1 is lowered to the first predetermined rotation speed Ne1. Therefore, the automatic stop control is continued. When the restart requirement is satisfied at time T5, the restart request flag (B) is set to 1. At the same time, the starter-motor driving flag (D) is set to 1 because it is determined that the restart request Nereq at the time of satisfaction of the restart requirement is lower than the first predetermined rotation speed Ne1 and equal to or higher than the second predetermined rotation speed Ne2. Therefore, the starter motor 19 is driven to start the rotational driving of the pinion gear 17 (see the broken line in the part (F) of FIG. 12).

Then, at time T6, the difference between the rotation speed Nm of the pinion gear 17 and the rotation speed Ne of the engine 1 (rotation speed of the ring gear 16) becomes equal to the difference in rotation speed at which the meshing-engagement is achieved. Therefore, the pinion-gear push-out condition is satisfied, and the pinion-gear push-out flag (C) is set to 1 so that the pinion gear 17 is pushed out. At the same time, the fuel supply from the fuel injection valve 12 is restarted. Then, at time T7, the ring gear 16 and the pinion gear 17 come into meshing engagement. As a result of the start of the acceleration of the engine 1 by the starter 15 and the restart of the combustion in the engine 1 by the start of the fuel supply from the fuel injection valve 12, the rotation speed Ne of the engine 1 increases. At time T8, the restart is completed (part (F) of FIG. 12).

When the restart is completed at time T8, the restart control means is terminated. The pinion-gear push-out flag (C) and the starter-motor driving flag (D) are set to 0 to stop the driving of the starter 15. At the same time, the throttle-valve control amount (G) is set to the normal control amount. The operation is switched to the normal operation such as the operation of bringing the clutch into engagement (part (E) of FIG. 12), and the restart request flag (B) is set to zero.

As described above, according to the automatic stop/restart device for the internal combustion engine according to Embodiment 1 of the present invention, the ring gear 16 and the pinion gear 17 can be reliably brought into meshing engagement to quickly perform the restart control in response to the satisfaction of the restart requirement without a sensor for detecting the rotation speeds of the ring gear 16 and the pinion gear 17. Therefore, the control means for the starter 15 is not complicated. Moreover, the driving characteristic of the series-coil starter motor as shown in FIG. 5 is used to simplify the device structure of the starter 15 and reduce an increase in weight and cost of the starter 15.

Moreover, when the rotation speed Ne of the engine 1 at the time of satisfaction of the restart requirement is low, specifically, the restart requirement has a strong possibility that the rotation speed Nm of the pinion gear 17 may exceed the rotation speed Ne of the engine 1 (rotation speed of the ring gear 16), the starter 19 is not driven by the starter-motor waiting-time adjustment means until the end of the meshing-engagement completion time Te in which the pinion gear 17 and the ring gear 16 come into meshing engagement. Therefore, the meshing engagement between the pinion gear 17 and the ring gear 16 does not fail. Therefore, the internal combustion engine can be restarted.

Further, the amount of control of the throttle valve 6 is limited while the engine 1 is in the automatically stopped state. Therefore, a fluctuation in rotation speed of the engine 1 after the engine 1 is automatically stopped can be reduced. As a result, the pinion gear 17 and the ring gear 16 can be reliably brought into meshing engagement. Therefore, the restart can be quickly performed.

Embodiment 2

An automatic stop/restart device for an internal combustion engine according to Embodiment 2 of the present invention is described referring to FIGS. 13 to 16. A configuration of the automatic stop/restart device for the internal combustion engine according to Embodiment 2 of the present invention is the same as that of Embodiment 1 described above.

A system configuration diagram, a control flowchart of the automatic stop/restart device for the internal combustion engine, and a block diagram and control flowcharts of restart control means according to Embodiment 2 are not different from those of Embodiment 1 described above. Embodiment 2 differs from Embodiment 1 only in the starter-motor waiting-time adjustment means (starter-motor waiting-time adjustment program). Therefore, the description of the same parts as those of Embodiment 1 is herein omitted, and only different points are described.

Figure 13:
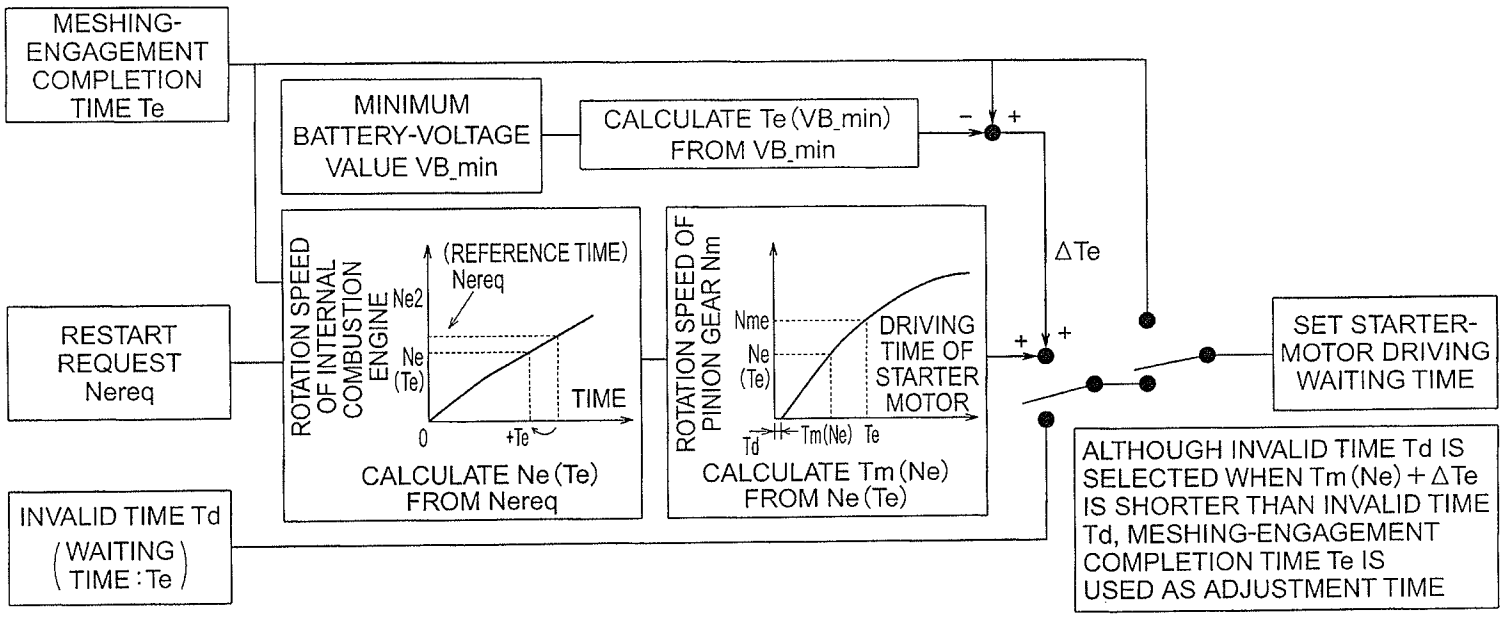
FIG. 13 is a block diagram illustrating an operation of starter-motor waiting-time adjustment means of an automatic stop/restart device for an internal combustion engine, according to Embodiment 2 of the present invention.
Figure 14:
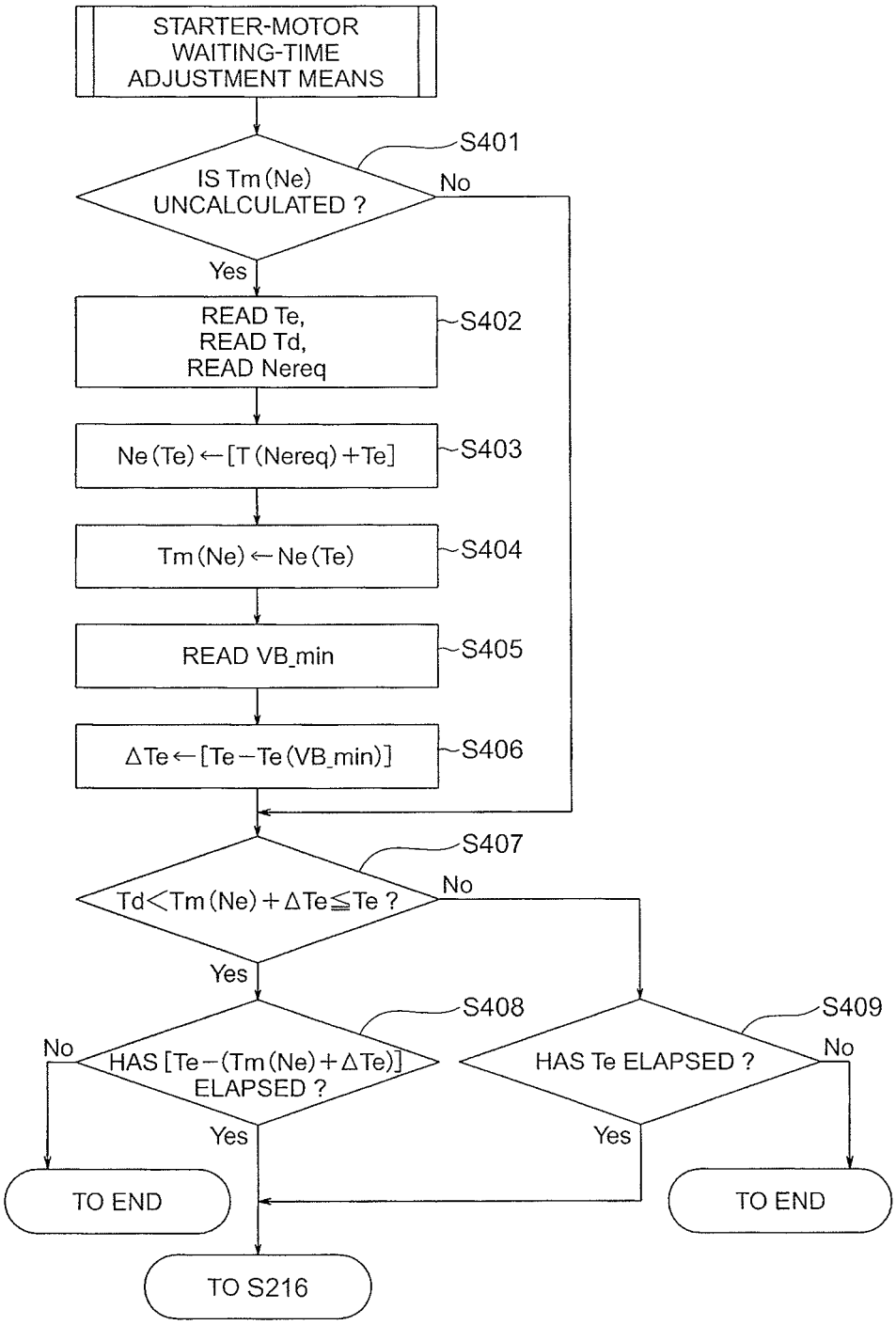
FIG. 14 is a flowchart illustrating the operation of the starter-motor waiting-time adjustment means of the automatic stop/restart device for the internal combustion engine, according to Embodiment 2 of the present invention.

An operation of the starter-motor waiting-time adjustment means of this Embodiment 2 is as illustrated in FIG. 13. In contrast to Embodiment 1, a starter-motor driving waiting time is set in view of a fluctuation in battery voltage. The details thereof are described referring to a flowchart of FIG.

14. Similarly to FIG. 6, the left graph of FIG. 13 corresponds to FIG. 7, whereas the right graph of FIG. 13 corresponds to FIG. 5.

First, when the starter-motor waiting-time adjustment means is executed, it is determined in S401 whether or not a starter-motor driving time Tm(Ne) is uncalculated. The starter-motor driving time Tm(Ne) is calculated in the order described below. It is apparent that the starter-motor driving time Tm is not calculated yet in the first routine of the starter-motor waiting-time adjustment means. Therefore, the result of determination is Yes, and the processing proceeds to S402. When the starter-motor waiting-time adjustment means is executed for the second or subsequent time, the starter-motor driving time Tm(Ne) is already calculated. Therefore, the processing proceeds to S407 described below.

In S402, the meshing-engagement completion time Te and the invalid time Td, which are prestored in the ROM 22C of the ECU 22, and the restart request Nereq stored in the RAM 22D, are read. Then, the processing proceeds to S403.

Next, in S403, the rotation speed Ne(Te) of the engine 1 at the end of the meshing-engagement completion time Te is calculated by using the relation shown in the left part of FIG. 13 (relation of FIG. 7) using the time corresponding to the thus read restart request Nereq as the reference time. Then, the processing proceeds to S404.

Next, in S404, the starter-motor driving time Tm(Ne) which corresponds to the time required for the restart request Nereq to reach the rotation speed Ne(Te) of the engine 1 at the end of the meshing-engagement completion time Te is calculated by using the relation shown in the right part of FIG. 13 (relation of FIG. 5). Then, the processing proceeds to S405.

Then, the processing proceeds to S405. In S405, a minimum voltage value VB_min of the battery 21 is read. The minimum voltage value VB_min of the battery 21 is a minimum value of a voltage value of the battery 21 when the voltage of the battery 21 greatly changes by the operation of the starter at the time of key-ON start or other automatic stop/restart. While the ECU 22 is operating, the minimum voltage value VB_min is always updated in the RAM 22D included in the ECU 22 each time the voltage of the battery 21 becomes minimum when the starter 15 is driven.

Figure 15:
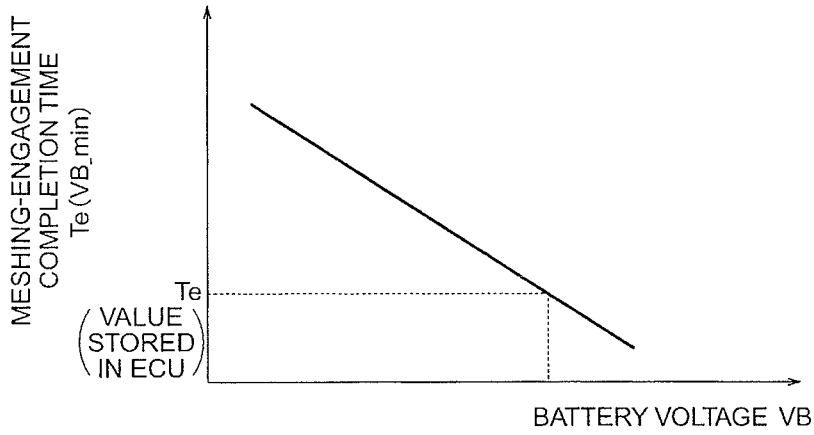
FIG. 15 is a graph showing a battery-voltage characteristic of the automatic stop/restart device for the internal combustion engine, according to Embodiment 2 of the present invention.

Next, the processing proceeds to S406. In S406, a meshing-engagement completion time Te(VB_min) at the minimum voltage value is calculated from the meshing-engagement completion time Te and the relation (battery-voltage characteristic) between the voltage VB of the battery 21 and the meshing-engagement completion time Te, which is previously obtained by an experiment or the like to be stored in the ROM 22C included in the ECU 22 and is shown in FIG. 15. Then, a difference therebetween, that is, a meshing-engagement completion delay time ΔTe (=Te−Te(VB_min)) is calculated. Then, the processing proceeds to S407.

The calculation of the meshing-engagement completion delay time is now described. In general, the voltage of the battery 21 greatly changes each time the starter 15 is driven by the key-ON start or the start of the restart control in a state in which the engine 1 is in the automatically stopped state. Moreover, the meshing-engagement completion time required for the pinion gear 17 pushed out by the pinion-gear push-out device 18 to come into meshing engagement with the ring gear 16 and the voltage of the battery 21 have the relation shown in FIG. 15. As the voltage of the battery 21 becomes lower, the amount of electric power supplied to the pinion-gear push-out device 18 becomes smaller. Therefore, the meshing-engagement completion time required to complete the meshing engagement between the pinion gear 17 and the ring gear 16 tends to be longer.

It is understood that a change in voltage of the battery 21 during the restart control is due to the driving of the starter motor 19. When the change in voltage occurs, however, the pinion gear 17 is being pushed out. Therefore, even if a driving force of the starter motor 19 is changed according to the change in voltage, it is difficult to reduce an increase in rotation speed of the pinion gear 17. As a result, there is a fear that the rotation speed Nm of the pinion gear 17 may become higher than the rotation speed Ne of the engine 1 (rotation speed of the ring gear 16) to result in failure in meshing engagement between the pinion gear 17 and the ring gear 16. Therefore, the meshing-engagement completion delay time ΔTe is calculated from the relation shown in FIG. 15 by using the minimum voltage value VB_min of the battery 21. Time at which the driving of the starter motor 19 is started is delayed by the obtained meshing-engagement completion delay time ΔTe. As a result, the meshing engagement can be reliably realized. Moreover, by using the minimum voltage value of the battery 21, a maximum delay in driving of the starter motor 19 at the time of execution of the restart control means is set. Therefore, the rotation speed Nm of the pinion gear 17 can be prevented from being excessively increased. Specifically, the possibility of increasing the rotation speed Nm of the pinion gear 17 to the rotation speed Ne of the engine (rotation speed of the ring gear 16) or higher can be reduced as much as possible.

In S407, it is determined whether or not the sum (add time) of the starter-motor driving time Tm(Ne) and the meshing-engagement completion delay time ΔTe is a value between the meshing-engagement completion time Te and the invalid time Td, which are read in S402. When the sum of the starter-motor driving time Tm(Ne) and the meshing-engagement completion delay time ΔTe is a value between the meshing-engagement completion time Te and the invalid time Td, the ring gear 16 and the pinion gear 17 can be brought into meshing engagement by driving the starter motor 19 while the pinion gear 17 is being pushed out. Therefore, when the result of determination is Yes in S407, the processing proceeds to S408. On the other hand, when the result of determination is No in S407, the processing proceeds to S409.

In S407, when the starter motor 19 is not driven even though the meshing-engagement completion delay time ΔTe is not added to the meshing-engagement completion time Te, a change in the amount of electric power supplied to the pinion-gear push-out device 18 is small. Therefore, the meshing-engagement completion time for the meshing engagement between the pinion gear 17 and the ring gear 16 becomes the shortest. In the case where the starter motor 19 is driven, the meshing-engagement completion time changes. However, the fluctuation in voltage of the battery 21 is not always the same, depending on the state of the battery 21. Moreover, in the case where the driving waiting time for the starter motor is long, specifically, when the restart requirement which reduces the driving time of the starter motor 19 is satisfied, a change in the meshing-engagement completion time Te is not large. Therefore, in view of the meshing-engagement completion delay time ΔTe, there is a fear that the meshing engagement fails. Therefore, in the case where the starter motor 19 is not driven, only the meshing-engagement completion time Te stored in the ROM 22C included in the ECU 22 is used for the comparative computation.

Then, the processing proceeds to S408. In S408, a time difference (Te−(Tm(Ne)+ΔTe)) between the meshing-engagement completion time Te and the sum of the starter-motor driving time Tm(Ne) and the meshing-engagement completion delay time ΔTe is calculated and it is determined whether or not the obtained time difference has elapsed. The obtained time difference corresponds to the driving waiting time for the starter motor 19. When the result of determination in S408 is Yes, the driving waiting time for the starter motor 19 has elapsed. Therefore, the processing proceeds to S216 of the restart control means where the starter motor 19 is driven by the starter-motor driving device 20. Then, the processing proceeds to S214 where the fuel supply from the fuel injection valve 12 is restarted. Then, the starter-motor waiting-time adjustment means is terminated. At the same time, the restart control means is terminated, and the processing returns. On the other hand, when the result of determination in S408 is No, the driving waiting time for the starter motor 19 has not elapsed. Therefore, the restart control means is terminated, and then the processing returns.

When the result of determination in S407 is NO, it is determined in S409 whether or not the time from the start of the pushing of the pinion gear 17 is equal to or longer than the meshing-engagement completion time Te as in the case of Embodiment 1. When the result of determination is Yes, it is determined that the meshing engagement between the ring gear 16 and the pinion gear 17 has been completed. Therefore, the processing proceeds to S216 of the restart control means where the starter motor 19 is driven by the starter-motor driving device 20. Then, the processing proceeds to S214 where the fuel injection from the fuel injection valve 12 is restarted to terminate the starter-motor waiting-time adjustment means. At the same time, the restart control means is terminated. In this case, the meshing-engagement time Te corresponds to the driving waiting time for the starter motor 19. When the result of determination in S409 is No, the restart control is terminated.

Figure 16:
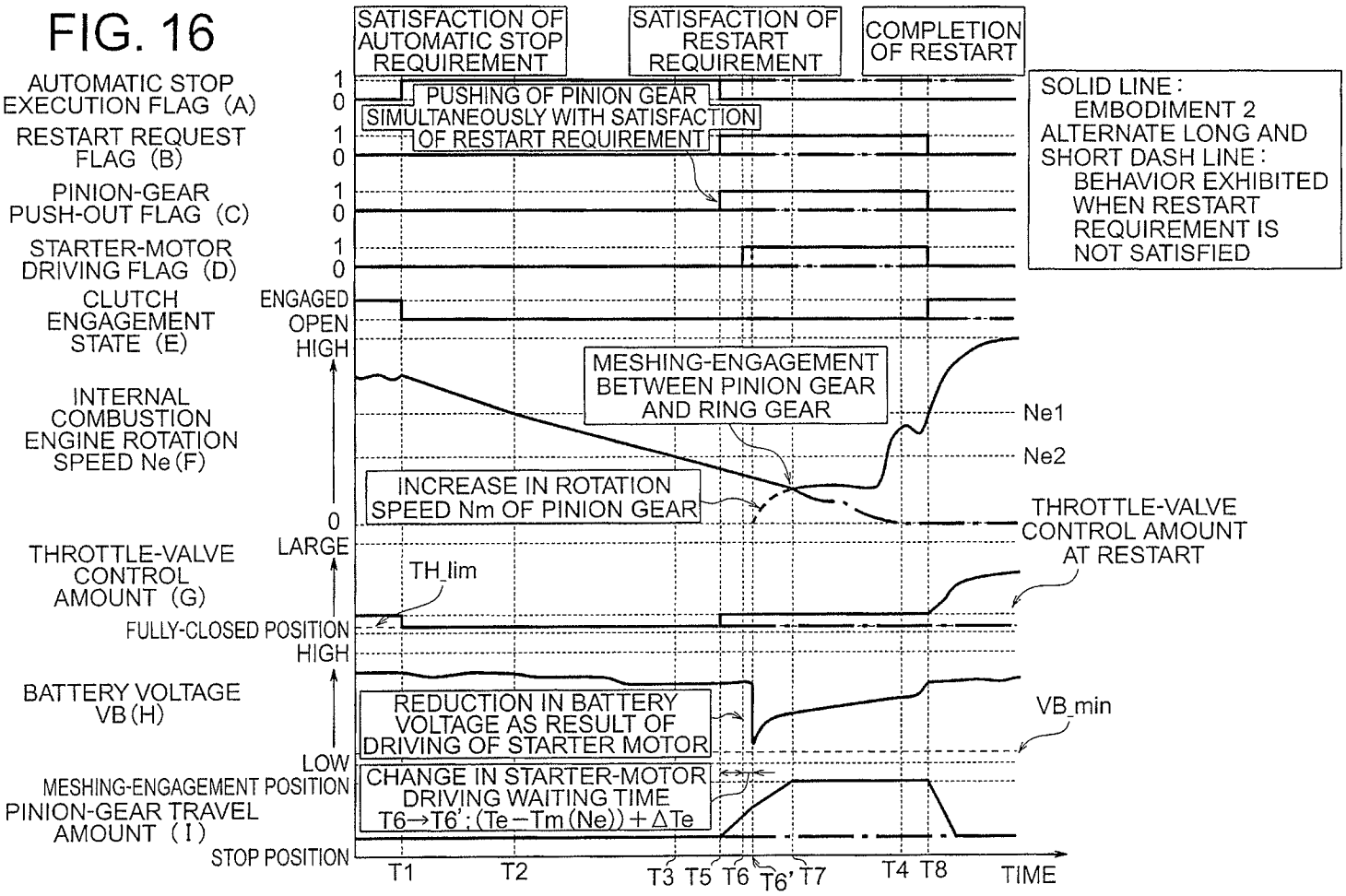
FIG. 16 is a timing chart illustrating behaviors of the automatic stop/restart device for the internal combustion engine according to Embodiment 2 of the present invention, which are exhibited when a restart requirement (second predetermined rotation speed Ne2>restart request Nereq) is satisfied while the internal combustion engine is rotating by inertia.

Next, an operation of the automatic stop/restart device for the internal combustion engine according to Embodiment 2 is described referring to a timing chart of FIG. 16. FIG. 16 differs from FIG. 9 in that a battery voltage VB (H) and a pinion-gear travel amount (I) are added. First, when the automatic stop requirement is satisfied at time T1, the fuel supply from the fuel injection valve 12 is stopped. At the same time, the throttle-valve control amount (G) is limited to the predetermined limit amount TH_lim. Moreover, the automatic stop control such as the operation of opening the clutch is performed as the clutch engagement state (E), and the automatic stop execution flag (A) is set to 1. By limiting the throttle-valve control amount (G) and performing the operation of opening the clutch as the clutch engagement state (E), a fluctuation in rotation speed Ne of the engine is reduced. As a result, the rotation speed Ne of the engine 1 reduces at a uniform rate.

The restart requirement is satisfied neither at time T2 nor at time T3. Therefore, the automatic stop control is continued. Then, at time T5, the restart requirement is satisfied. The rotation speed Ne of the engine 1 at the time of satisfaction of the restart requirement is lower than the first predetermined rotation speed Ne1 and the second predetermined rotation speed Ne2. Therefore, the pinion-gear push-out flag (C) is set to 1, and the pushing of the pinion gear 17 is started (part (I) of FIG. 16). At the same time, it is determined whether or not the starter motor 19 is driven based on the time to the end of the meshing-engagement completion time Te. In contrast to Embodiment 1, however, the minimum voltage value VB_min of the battery 21 is used and the meshing-engagement completion delay time ΔTe is taken into consideration so as to determine whether or not the starter motor 19 is driven.

In the case where there is no meshing-engagement completion delay time ΔTe, the driving of the starter motor 19 is started at time T6 to start the rotational driving of the pinion gear 17. In view of the meshing-engagement completion delay time ΔTe, however, the time at which the driving of the starter motor 19 is started is delayed from time T6 to time T6'. By delaying the start of the driving of the starter motor 19 by the meshing-engagement completion delay time ΔTe, the rotation speed Nm of the pinion gear 17 does not exceed the rotation speed Ne of the engine 1 (rotation speed of the ring gear 16). Moreover, the voltage of the battery 21 is greatly lowered because the starter motor 19 is driven (at time T6' in the part (H) of FIG. 16).

Thereafter, the pinion gear 17 moves toward the ring gear 16 (part (I) of FIG. 16) while the rotation speed Nm of the pinion gear 17 is increasing (indicated by the broken line shown in part (F) of FIG. 16). At time T7, the pinion gear 17 and the ring gear 16 come into meshing engagement to accelerate the engine 1. At the same time, the combustion in the engine 1 is restarted to increase the rotation speed Ne of the engine 1 because the fuel injection has been restarted. At time T8, the restart is completed.

When the restart is completed at time T8, the pinion-gear push-out flag (C) and the starter-motor driving flag (D) are set to zero. At the same time, the throttle-valve control amount (G) is set to the normal control amount. Moreover, the restart control is switched to the normal control such as the operation of bringing the clutch into engagement as the clutch engagement state (E). In this manner, the restart control is terminated. At the same time, the restart request flag (B) is set to zero. Further, the restart control means is terminated to stop the driving of the starter 15. Therefore, the battery voltage VB (H) is recovered, whereas the pinion gear 17 returns to a stop position as the pinion-gear travel amount (I).

As described above, according to the automatic stop/restart device for the internal combustion engine according to Embodiment 2, the pinion gear 17 and the ring gear 16 can be reliably brought into meshing engagement to quickly perform the restart control in response to the satisfaction of the restart requirement without the sensor for detecting the rotation speeds of the ring gear 16 and the pinion gear 17. Therefore, the control means for the starter 15 is not complicated. In the case where the restart requirement is satisfied while the engine 1 is rotating by inertia at the rotation speed equal to or lower than the second predetermined rotation speed Ne2, the driving of the starter motor 19 is started while the pinion gear is being pushed out so that the pinion gear 17 and the ring gear 16 come into meshing engagement to perform the restart. In this case, the driving of the starter motor 19 is adjusted in view of the fluctuation in voltage of the pinion-gear push-out device 18. Therefore, the pinion gear 17 and the ring gear 16 can be reliably brought into meshing engagement to perform the restart. Moreover, the driving characteristic of the series-coil starter motor as shown in FIG. 5 is used to simplify the device structure of the starter 15 and reduce an increase in weight and cost of the starter 15.

Moreover, when the rotation speed Ne of the engine 1 at the time of satisfaction of the restart requirement is low, specifically, the restart requirement has a strong possibility that the rotation speed Nm of the pinion gear 17 may exceed the rotation speed Ne of the engine 1 (rotation speed of the ring gear 16), the starter 19 is inhibited from being driven by the starter-motor waiting-time adjustment means until the end of the meshing-engagement completion time Te in which the pinion gear 17 and the ring gear 16 come into meshing engagement. Therefore, the meshing engagement between the pinion gear 17 and the ring gear 16 does not fail. Therefore, the internal combustion engine can be restarted.

What is claimed is:

1. An automatic stop/restart device for an internal combustion engine, for automatically stopping the internal combustion engine when a predetermined automatic stop requirement is satisfied during an operation of the internal combustion engine and for restarting the internal combustion engine when a predetermined restart requirement is satisfied while the internal combustion engine is in an automatically stopped state, comprising:

a rotation-speed computation means for computing a rotation speed of the internal combustion engine;

a starter including a pinion gear to be brought into meshing engagement with a ring gear connected to a crankshaft of the internal combustion engine to rotationally drive the ring gear, a pinion-gear push-out device for bringing the pinion gear into the meshing engagement with the ring gear, a starter motor for rotationally driving the pinion gear, and a starter-motor driving device for driving the starter motor; and a restart control means (a) for allowing the pinion-gear push-out device to push out the pinion gear, after elapse of a driving waiting time for the starter motor, which is computed based on a plurality of characteristics obtained in advance, (b) for allowing the starter-motor driving device to drive the starter motor, and (c) for restarting fuel supply from a fuel injection valve to a combustion chamber of the internal combustion engine, when the rotation speed of the internal combustion engine at time of satisfaction of the predetermined restart requirement, the rotation speed being computed by the rotation-speed computation means, is lower than a lower limit rotation speed, wherein the lower limit rotation speed is a speed at which the starter can be operated in order of the driving of the starter motor and the pushing of the pinion gear, and the predetermined restart requirement is satisfied while the internal combustion engine is rotating by inertia after being automatically stopped, wherein the driving waiting time computation includes a rotation speed of the internal combustion engine obtained after a meshing-engagement completion time, which is determined from the rotation speed of the internal combustion engine at a restart request.

2. An automatic stop/restart device for an internal combustion engine according to claim 1, wherein the restart control means includes starter-motor waiting-time adjustment means for obtaining the driving waiting time for the starter motor, the starter-motor waiting-time adjustment means being configured to:

use a rotation-speed reduction characteristic of the internal combustion engine, which indicates a relation between time and the rotation speed of the internal combustion engine, to calculate the rotation speed of the internal combustion engine after elapse of the meshing-engagement completion time corresponding to a time period from start of the pushing of the pinion gear to completion of the meshing engagement between the pinion gear and the ring gear based on time corresponding to the rotation speed of the internal combustion engine obtained when the restart request is made as a reference time;

use a starter-motor driving characteristic indicating a relation between a driving time of the starter motor and a rotation speed of the pinion gear to calculate a starter-motor driving time corresponding a time period required for the rotation speed of the internal combustion engine obtained when the restart request is made to reach the rotation speed of the internal combustion engine after the elapse of the meshing-engagement completion time; and obtain a time difference between the meshing-engagement completion time and the starter-motor driving time as the driving waiting time for the starter motor, when the time difference elapses in a case where the starter-motor driving time is longer than an invalid time corresponding to a time period from start of the driving of the starter motor by the starter-motor driving device to start of rotational driving of the pinion gear and is equal to or shorter than the meshing-engagement completion time.

3. An automatic stop/restart device for an internal combustion engine according to claim 1, wherein the restart control means includes starter-motor waiting-time adjustment means for obtaining the driving waiting time for the starter motor, the starter-motor waiting-time adjustment means being configured to:

use a rotation-speed reduction characteristic of the internal combustion engine, which indicates a relation between time and the rotation speed of the internal combustion engine, to calculate the rotation speed of the internal combustion engine after elapse of the meshing-engagement completion time corresponding to a time period from start of the pushing of the pinion gear to completion of the meshing engagement between the pinion gear and the ring gear based on time corresponding to the rotation speed of the internal combustion engine obtained when the restart request is made as a reference time;

use a starter-motor driving characteristic indicating a relation between a driving time of the starter motor and a rotation speed of the pinion gear to calculate a starter-motor driving time corresponding a time period required for the rotation speed of the internal combustion engine obtained when the restart request is made to reach the rotation speed of the internal combustion engine after the elapse of the meshing-engagement completion time; and obtain the meshing-engagement completion time as the driving waiting time for the starter motor, when the meshing-engagement completion time elapses from the start of the pushing of the pinion gear in a case where the starter-motor driving time is one of equal to or shorter than an invalid time corresponding to a time period from start of the driving of the starter motor by the starter-motor driving device to start of rotational driving of the pinion gear and longer than the meshing-engagement completion time.

4. An automatic stop/restart device for the internal combustion engine according to claim 1, wherein the restart control means includes starter-motor waiting-time adjustment means for obtaining the driving waiting time for the starter motor, the starter-motor waiting-time adjustment means being configured to:

use a rotation-speed reduction characteristic of the internal combustion engine which indicates a relation between time and the rotation speed of the internal combustion engine, to calculate the rotation speed of the internal combustion engine after elapse of the meshing-engagement completion time corresponding to a time period from start of the pushing of the pinion gear to completion of the meshing engagement between the pinion gear and the ring gear based on time corresponding to the rotation speed of the internal combustion engine obtained when the restart request is made as a reference time;

use a starter-motor driving characteristic indicating a relation between a driving time of the starter motor and a rotation speed of the pinion gear to calculate a starter-motor driving time corresponding a time period required for the rotation speed of the internal combustion engine obtained when the restart request is made to reach the rotation speed of the internal combustion engine after the elapse of the meshing-engagement completion time;

use a battery-voltage characteristic indicating a relation between a voltage of a battery for supplying electric power to the starter and the meshing-engagement completion time to calculate the meshing-engagement completion time at a minimum voltage value so as to calculate a meshing-engagement completion delay time corresponding to a difference between the meshing-engagement completion time and the meshing-engagement completion time at the minimum voltage value; and obtain a time difference between the meshing-engagement completion time and an add time of the starter-motor driving time and the meshing-engagement completion delay time as the driving waiting time for the starter motor when the time difference elapses in a case where the add time is longer than an invalid time corresponding to a time period from start of driving of the starter motor by the starter-motor driving device to start of rotational driving of the pinion gear and is equal to or shorter than the meshing-engagement completion time.

5. An automatic stop/restart device for the internal combustion engine according to claim 1, wherein the restart control means includes starter-motor waiting-time adjustment means for obtaining the driving waiting time for the starter motor, the starter-motor waiting-time adjustment means being configured to:

use a rotation-speed reduction characteristic of the internal combustion engine which indicates a relation between time and the rotation speed of the internal combustion engine, to calculate the rotation speed of the internal combustion engine after elapse of the meshing-engagement completion time corresponding to a time period from start of the pushing of the pinion gear to completion of the meshing engagement between the pinion gear and the ring gear based on time corresponding to the rotation speed of the internal combustion engine obtained when the restart request is made as a reference time;

use a starter-motor driving characteristic indicating a relation between a driving time of the starter motor and a rotation speed of the pinion gear to calculate a starter-motor driving time corresponding a time period required for the rotation speed of the internal combustion engine obtained when the restart request is made to reach the rotation speed of the internal combustion engine after the elapse of the meshing-engagement completion time;

use a battery-voltage characteristic indicating a relation between a voltage of a battery for supplying electric power to the starter and the meshing-engagement completion time to calculate the meshing-engagement completion time at a minimum voltage value so as to calculate a meshing-engagement completion delay time corresponding to a difference between the meshing-engagement completion time and the meshing-engagement completion time at the minimum voltage value; and obtain the meshing-engagement completion time as the driving waiting time for the starter motor when the meshing-engagement completion time elapses from the start of the pushing of the pinion gear in a case where an add time of the starter-motor driving time and the meshing-engagement completion delay time is one of equal to or shorter than an invalid time corresponding to a time period from start of driving of the starter motor by the starter-motor driving device to the start of rotational driving of the pinion gear and longer than the meshing-engagement completion time.

* * * * *